US008944244B2

(12) United States Patent
Lee et al.

(10) Patent No.: US 8,944,244 B2
(45) **Date of Patent: *Feb. 3, 2015**

(54) CAP ASSEMBLY HAVING STORAGE CHAMBER FOR SECONDARY MATERIAL WITH MOVABLE WORKING MEMBER

(71) Applicants: Jeong-Min Lee, Seoul (KR); Seong-Jae Lee, Seoul (KR)

(72) Inventors: Jeong-Min Lee, Seoul (KR); Seong-Jae Lee, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/669,902

(22) Filed: Nov. 6, 2012

(65) Prior Publication Data

US 2013/0306499 A1 Nov. 21, 2013

Related U.S. Application Data

(63) Continuation of application No. 12/593,681, filed as application No. PCT/KR2007/001489 on Mar. 27, 2007, now Pat. No. 8,328,010.

(30) Foreign Application Priority Data

| | | |
|---|---|---|
| Mar. 27, 2006 | (KR) | 10-2006-0028270 |
| Apr. 9, 2006 | (KR) | 10-2006-0032693 |
| May 1, 2006 | (KR) | 10-2006-0040365 |
| May 1, 2006 | (KR) | 10-2006-0040366 |
| May 1, 2006 | (KR) | 10-2006-0040367 |
| May 1, 2006 | (KR) | 10-2006-0040369 |
| May 3, 2006 | (KR) | 10-2006-0041815 |
| May 15, 2006 | (KR) | 10-2006-0044576 |
| Jul. 12, 2006 | (KR) | 10-2006-0066676 |
| Oct. 9, 2006 | (KR) | 10-2006-0099321 |
| Oct. 9, 2006 | (KR) | 10-2006-0099322 |
| Nov. 8, 2006 | (KR) | 10-2006-0111395 |
| Nov. 27, 2006 | (KR) | 10-2006-0119151 |

(51) Int. Cl.

| | |
|---|---|
| ***B65D 25/08*** | (2006.01) |
| ***B65D 51/28*** | (2006.01) |
| ***B65D 47/24*** | (2006.01) |

(52) U.S. Cl.

CPC ..... *B65D 51/2864* (2013.01); *B65D 47/243* (2013.01)

USPC ..... 206/221

(58) Field of Classification Search

USPC ..... 206/219–222, 568; 215/DIG. 8; 222/58, 222/80, 81, 129.1, 129.2, 145.1, 325

See application file for complete search history.

(56) References Cited

U.S. PATENT DOCUMENTS

| | | | | |
|---|---|---|---|---|
| 937,049 | A | 10/1909 | Callahan | |
| 3,651,990 | A * | 3/1972 | Cernei | 206/221 |

(Continued)

FOREIGN PATENT DOCUMENTS

| | | |
|---|---|---|
| JP | 7-309376 | 11/1995 |
| JP | 2003-002350 | 1/2003 |
| WO | 03/059774 A2 | 7/2003 |

OTHER PUBLICATIONS

Non-Final Rejection for related U.S. Appl. No. 12/593,681, dated Sep. 8, 2011, 8 pages.

(Continued)

*Primary Examiner* — Luan K Bui

(74) *Attorney, Agent, or Firm* — Westman, Champlin & Koehler, P.A.

(57) ABSTRACT

The storage chamber for secondary material applicable to the discharging direction of contents stored in the container consists of body with storage space and inseparable operating section mounted around the globe. If above operating section moves up, opening and closing hole made or formed in the storage space of storage is opened and contents stored in the storage space is dropped and mixed with contents stored in the container. The mixed contents are discharged via a vent mounted on the top of operating section. A vent is not opened until the operating section is opened, and closing section of opening and closing hole is provided so that the opening and closing hole may not be not clogged after being opened.

16 Claims, 49 Drawing Sheets

(56) References Cited

U.S. PATENT DOCUMENTS

| | | | | |
|---|---|---|---|---|
| 4,177,938 | A * | 12/1979 | Brina | 206/222 |
| 4,591,050 | A * | 5/1986 | Finke et al. | 206/222 |
| 4,793,475 | A | 12/1988 | Itzel | 206/221 |
| 5,373,937 | A | 12/1994 | Lamboy | 206/221 |
| 5,417,321 | A * | 5/1995 | Halm | 206/221 |
| 6,045,254 | A * | 4/2000 | Inbar et al. | 206/222 |
| 6,230,884 | B1 | 5/2001 | Coory | 206/222 |
| 6,820,740 | B1 | 11/2004 | Spector | 206/219 |
| 6,840,373 | B2 * | 1/2005 | Gibler et al. | 206/219 |
| 6,854,595 | B2 | 2/2005 | Kiser | 206/222 |
| 6,962,254 | B2 | 11/2005 | Spector | 206/222 |
| 7,588,142 | B1 | 9/2009 | Bush | 206/221 |
| 8,328,010 | B2 | 12/2012 | Lee et al. | 206/221 |
| 2003/0072850 | A1 | 4/2003 | Burniski | 426/115 |
| 2005/0150902 | A1 * | 7/2005 | Cho | 222/58 |
| 2005/0211579 | A1 * | 9/2005 | Makita | 206/219 |
| 2005/0263414 | A1 * | 12/2005 | Harilela et al. | 206/221 |
| 2006/0118435 | A1 * | 6/2006 | Cronin et al. | 206/219 |
| 2006/0137998 | A1 * | 6/2006 | Spector et al. | 206/219 |

OTHER PUBLICATIONS

Final Rejection for related U.S. Appl. No. 12/593,681, dated Apr. 24, 2012, 8 pages.

International Search Report for PCT/KR2007/001489, filed Mar. 27, 2007, mailed Sep. 10, 2007, 2 pages.

* cited by examiner

CAP ASSEMBLY HAVING STORAGE CHAMBER FOR SECONDARY MATERIAL WITH MOVABLE WORKING MEMBER

CROSS-REFERENCE TO RELATED APPLICATION

The present application is a Continuation of patent application U.S. Ser. No. 12/593,681, filed Sep. 29, 2009, now U.S. Pat. No. 8,328,010, which is a Section 371 National Stage Application of International patent application Serial No. PCT/KR2007/001489, filed Mar. 27, 2007, and published as WO 2007/111463 on Oct. 4, 2007, in English the content of which is hereby incorporated by reference in its entirety.

TECHNICAL FIELD

This invention is on the storage chamber for secondary material. In detail, this invention is on the structure of storage chamber required for effectively mixing the concentrate and water or concentrate and general beverage or granule and water or powder and water.

This invention may be used for the diverse purposes to improve the mixing efficiency of different materials such as medical, pharmaceutical, cosmetic and industrial purposes.

BACKGROUND TECHNOLOGIES

Additional space is required in the container for mixing the powder or concentrate with the liquid beverage stored in the container.

The structures intended to mix other materials in these containers have been invented through the U.S. Pat. No. 6,962,254, U.S. Pat. No. 6,230,884 and U.S. Pat. No. 6,854,595.

However, this structure has not been popularized because it shows some problems in terms of function, mixing efficiency, adaptability to production line and use convenience.

The technology (PCT/EP2002/004523: Jan. 174, 2002) invented or developed by a joint venture organized among an American company, German company and Austrian company and another technology invented or developed by a Japanese company are highlighted in the global market. However, the technology invented or developed by a Japanese company is commercialized for the first time in the world.

However, the technology (JP-P-2001-00185428: Jun. 19, 2001) invented or developed by a Japanese company shows a problem. In other words, the part forming a part of opening section drops in the container and children may swallow this dropped part, so the container neck of new form focused on preventing the separation of exhaust device is developed. However, this neck is inapplicable to the existing container, so this new container neck has some problem as well.

Also, the invention, recorded via an U.S. Patent No. 2003-72850, shows some problems in terms of airtight, operating efficiency, or when manufacturing the mold and filling the content.

DETAILED DESCRIPTIONS OF INVENTION

Technical Problems

The purpose of this invention is to enable the people to easily drink the beverage via an operating section mounted on this invention.

Another purpose of this invention is to provide the storage chamber for secondary material promising the use convenience by allowing the contents stored in the storage space to be dropped and mixed in the container.

Other purpose of this invention is to enable the contents stored in the storage space to be easily mixed by preventing the closing section (35) of opening and closing hole from being closed after being opened.

Other purpose of this invention is to prevent the refill of poisonous substances or foreign substances in the storage space of reception section by designing the closing section not to be closed again after the closing section is separated from the reception section.

How to Technically Solve the Problems

Storage chamber for secondary material, invented or developed by this invention under the intention of accomplishing above goals, consists of body combined or adhered to the direction where the contents stored in the container is discharged, storage (storage space of contents). The contents stored in this storage are opened when the operating section moves up and down and then dropped and mixed with contents stored in the container.

The structure for mixing the different materials developed or invented by this invention is combined, attached and adhered to the direction where the contents stored in the container are discharged. Above storage for mixing the different materials consists of body with storage and opening and closing hole to open and close the contents stored in the storage space mounted on the bottom of storage.

Above opening and closing hole is closed by the operating section combined or connected to the globe of body and closing section of opening and closing hole connected to the operating section, and if the operating section moves up, opening and closing hole is opened and contents mixed in the container are discharged via a vent operated when the operating section moves up. This storage chamber for secondary material is characterized by its above components.

Also, if above operating section is closed, closing section of opening and closing hole does not close the opening and closing hole because of removal rack, so it remains opened.

Expected Effects

This invention enables its users to easily drop and mix the different materials only by opening the operating section after storing the powder and granule or concentrate in the additional storage space separated from the contents stored in the container.

Also, this invention enables its users to conveniently drink the beverage via an operating section.

Also, the closing section of opening and closing hole is not opened again after it is opened, so it is not available to fill any foreign substance in the storage or change the contents.

BRIEF DESCRIPTION OF THE DRAWINGS

The FIGS. 1 thru 6 show the desirable operations of this invention.

The FIG. 1 shows the appearance of this invention when the opening and closing hole is opened.

Figure 2:
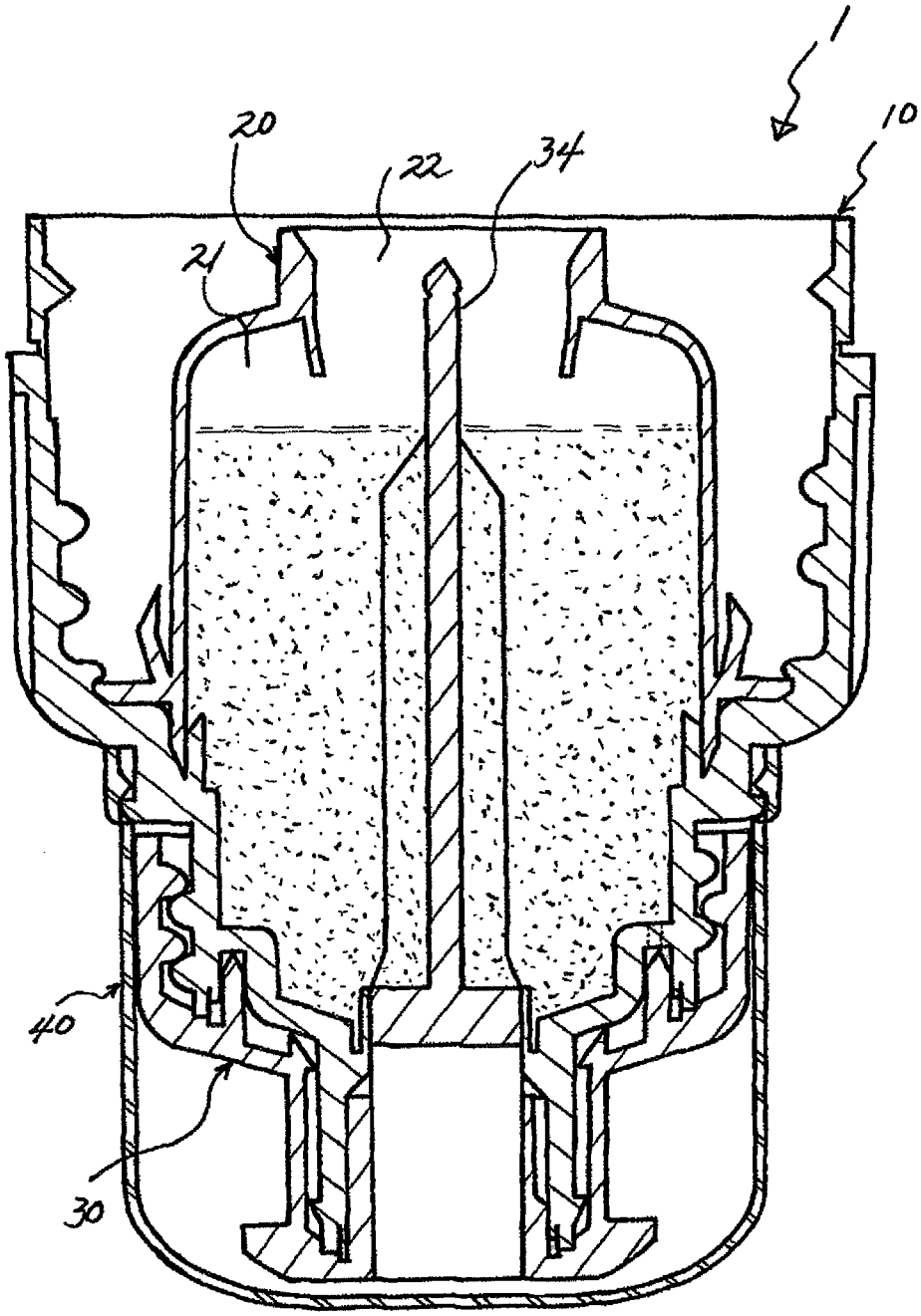

The FIG. 2 shows the appearance of this invention when the storage space is filled with the contents via an opened hole.

Figure 3:
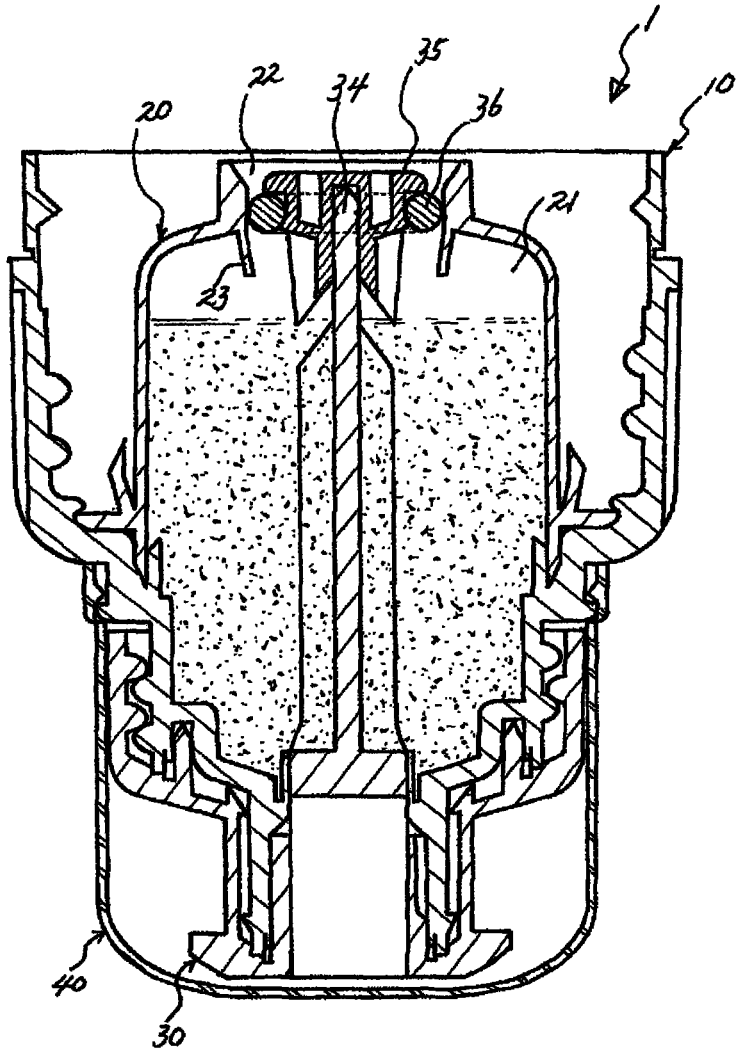

The FIG. 3 shows that the opening and closing hole is closed by the closing section after filling the storage space with contents.

Figure 4:
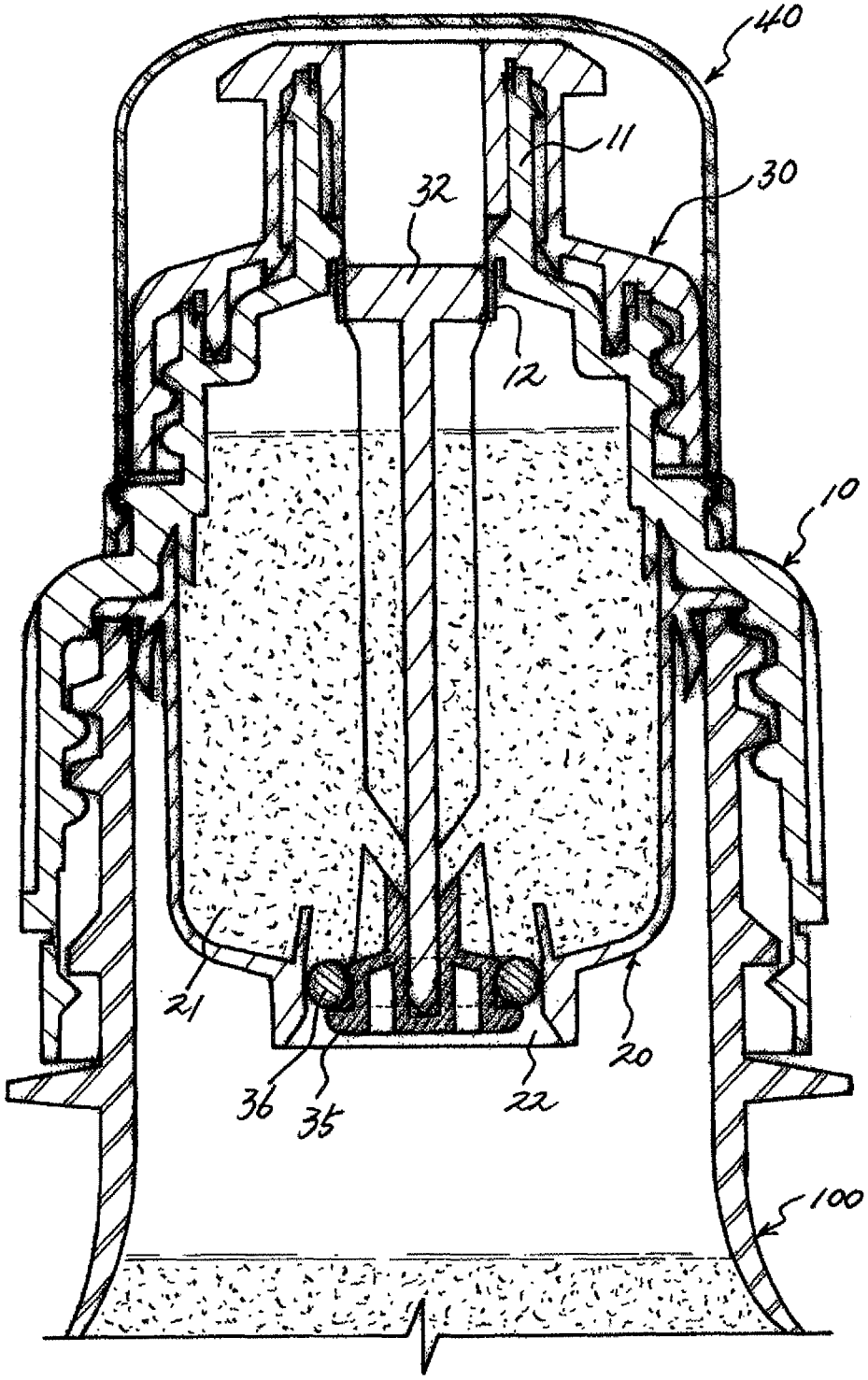

The FIG. 4 shows that the storage chamber for secondary material is combined with the container.

Figure 5:
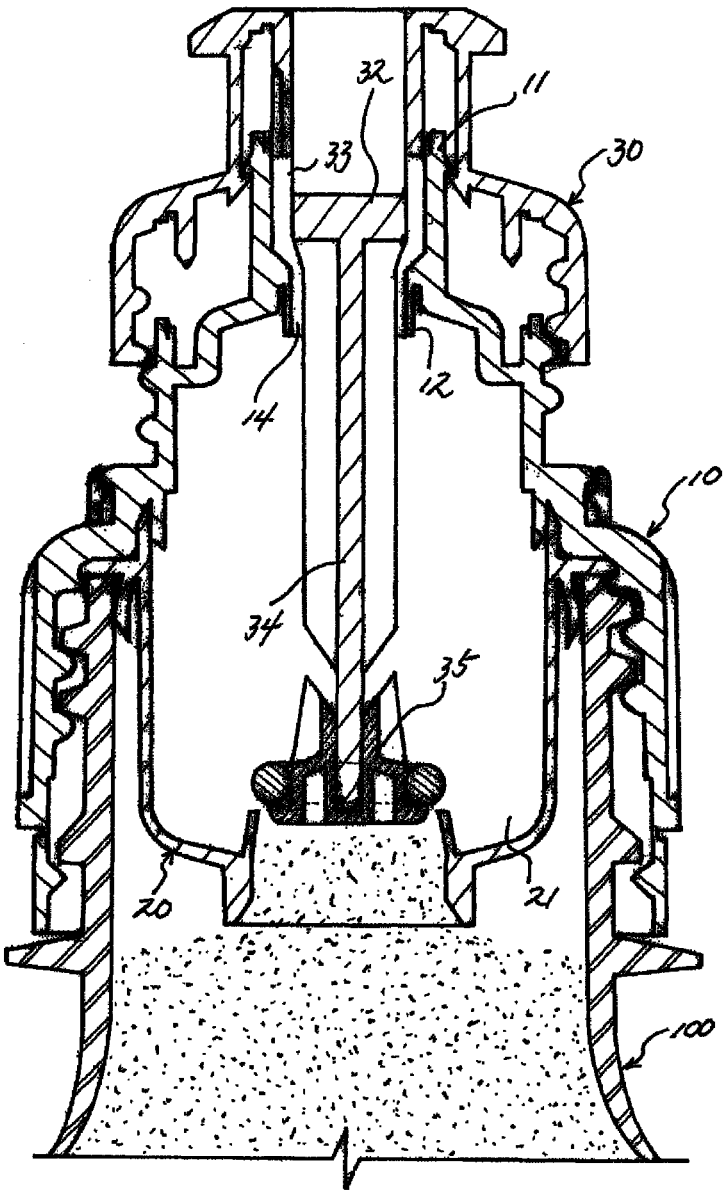

The FIG. 5 shows that the contents, stored in the storage space of receiving section, are dropped and mixed in the container when moving up the operating section.

Figure 6:
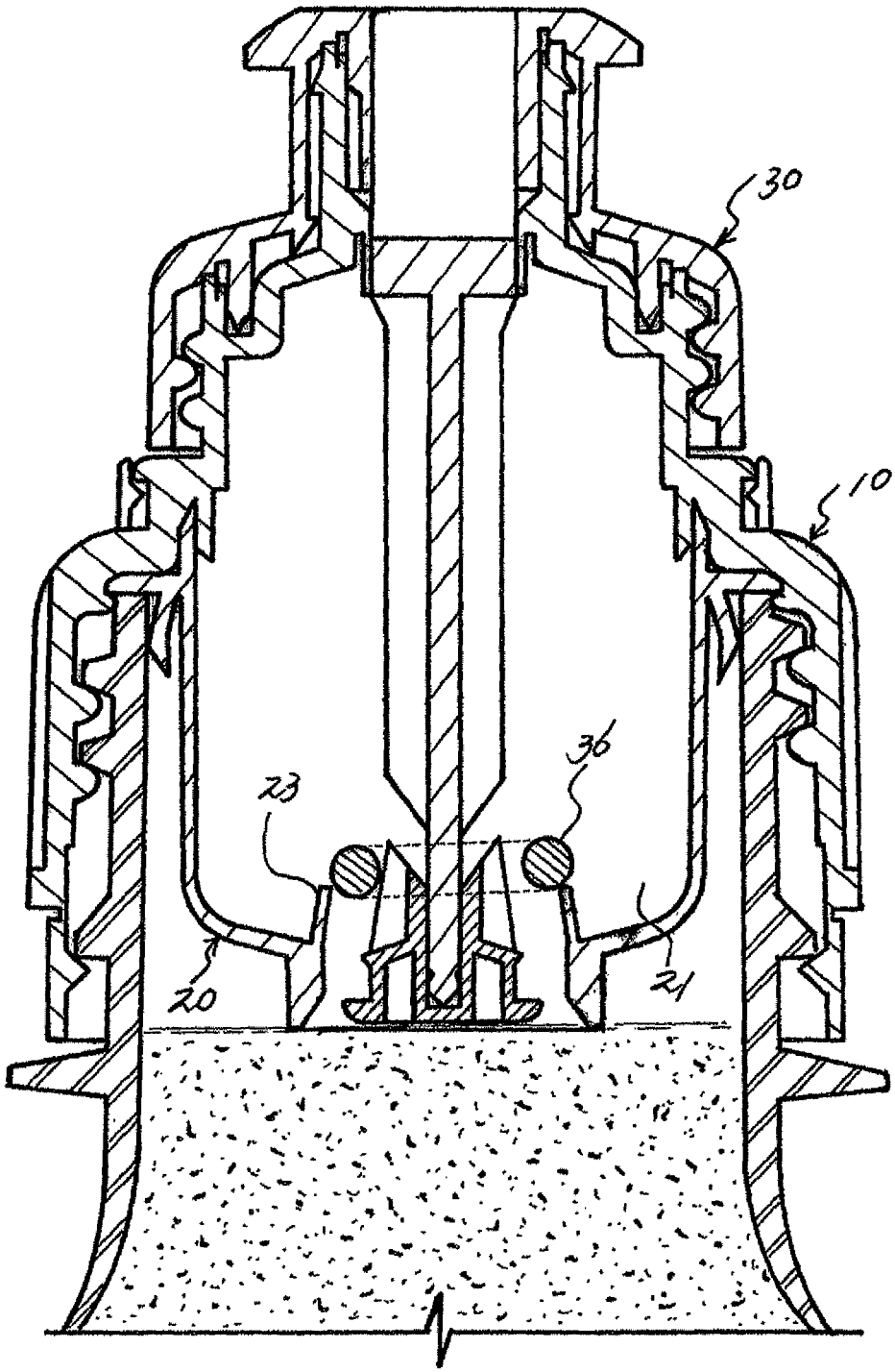

The FIG. 6 shows that the operating & closing section opens the opening and closing hole after being caught by the removal rack when returning the operating section to its original position under the condition shown in the FIG. 5.

The FIGS. 7 thru 23 show the other operations of this invention.

Figure 7:
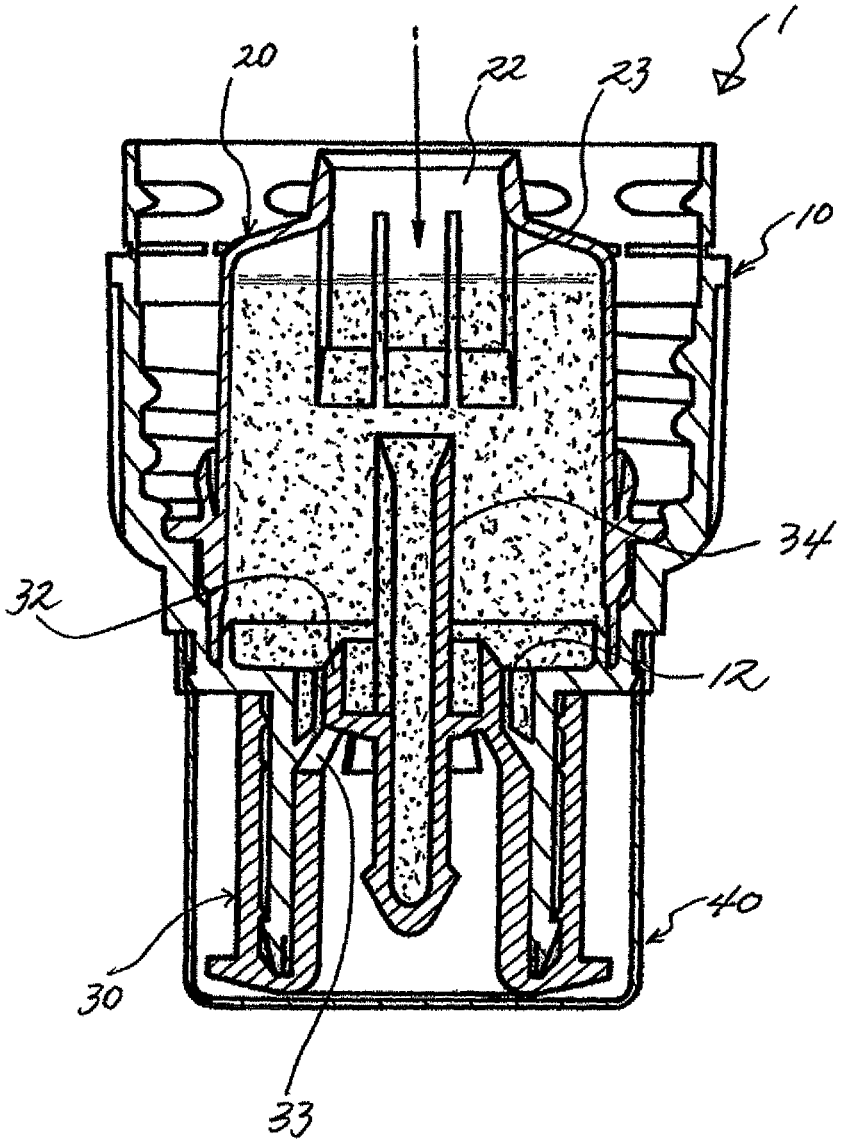

The FIG. 7 shows that the storage space is filled with the contents via an opening and closing hole.

Figure 8:
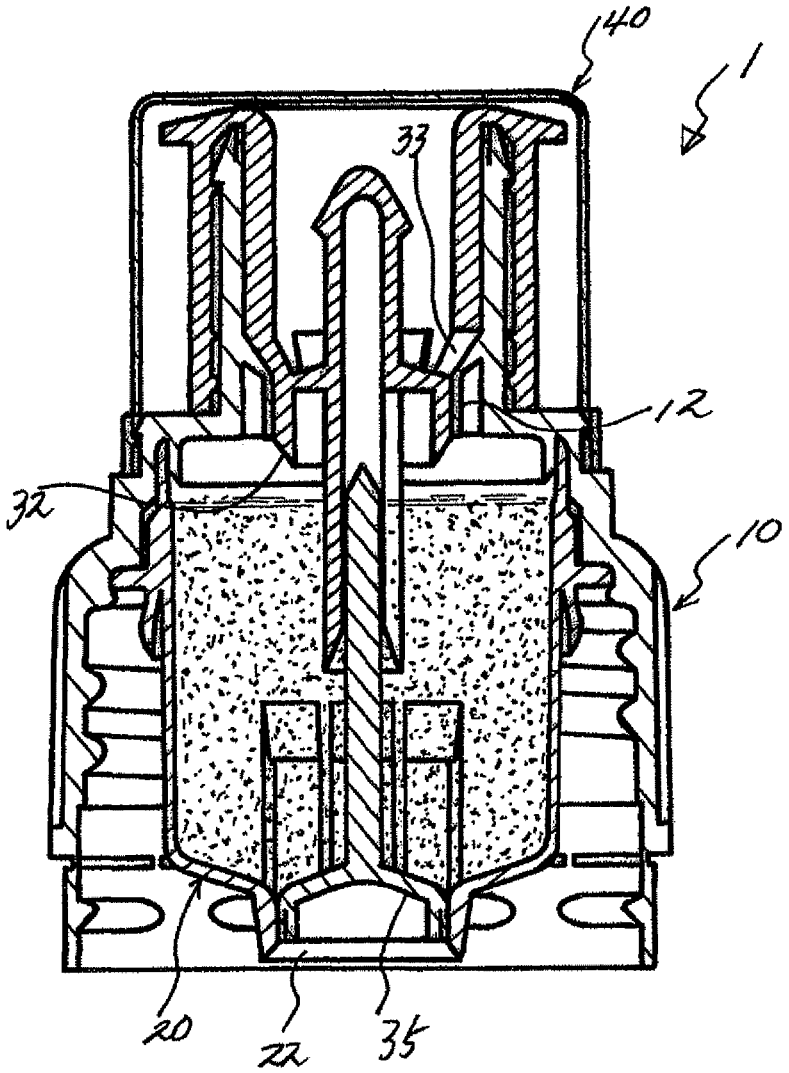

The FIG. 8 shows that the closing section is assembled in the opening and closing hole.

Figure 9:
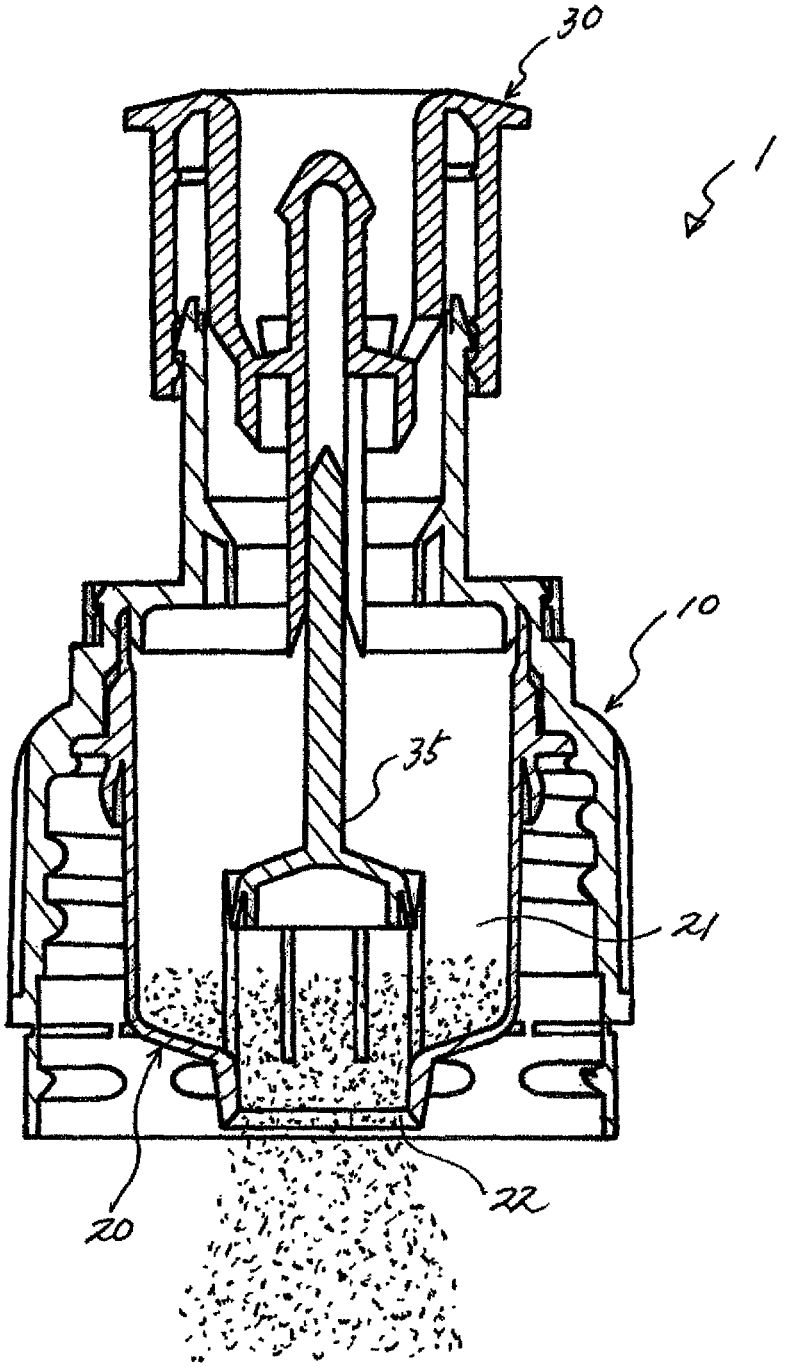

The FIG. 9 shows that the operating section is used after being lifted.

Figure 10:
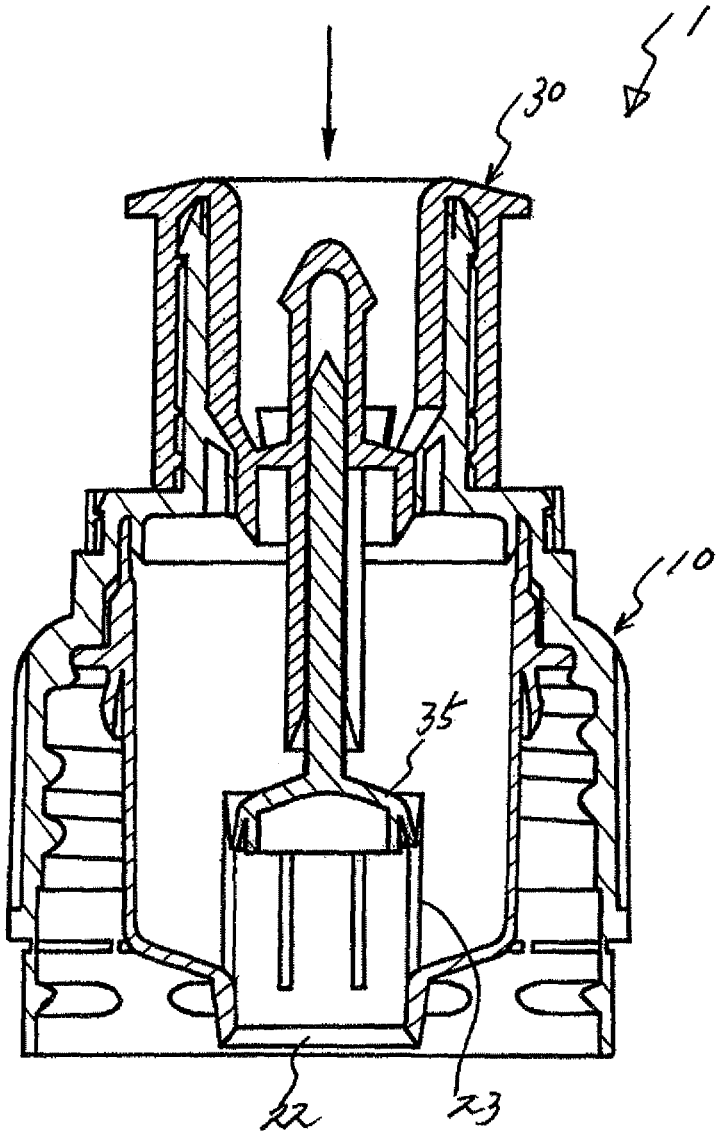

The FIG. 10 shows that the operating section is closed again.

Figure 11:
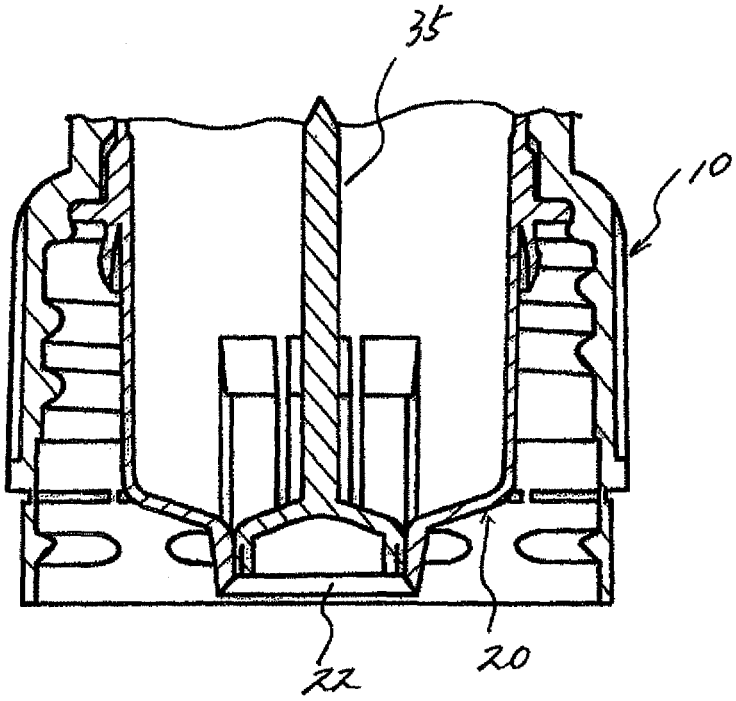

The FIG. 11 shows an example when the closing section of opening and closing hole is transformed.

Figure 12:
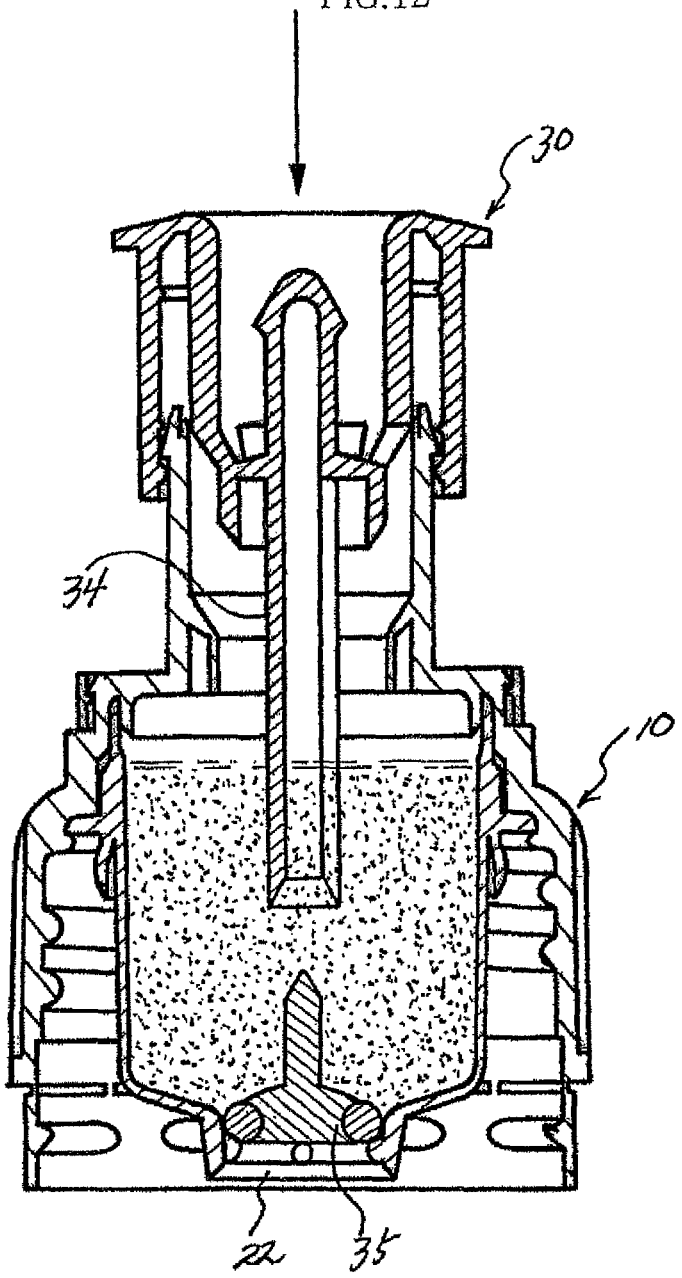

The FIG. 12 shows the other operations of closing section of opening and closing hole.

The FIGS. 13 thru 17 show an example when the operating section is transformed.

Figure 18:
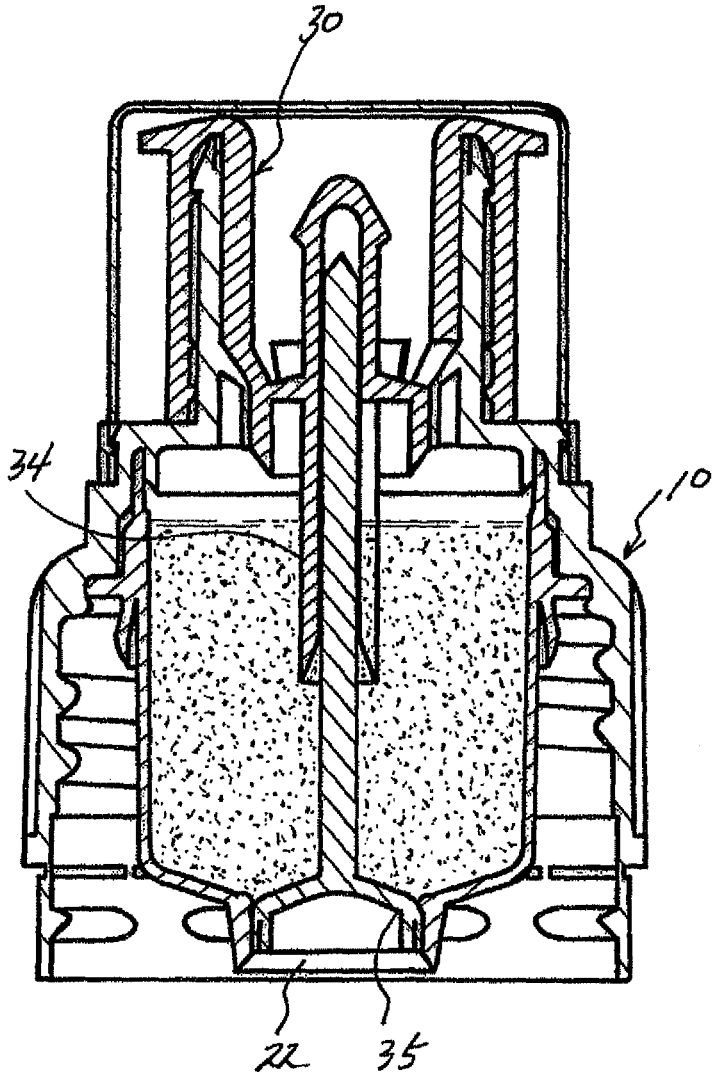
Figure 19:
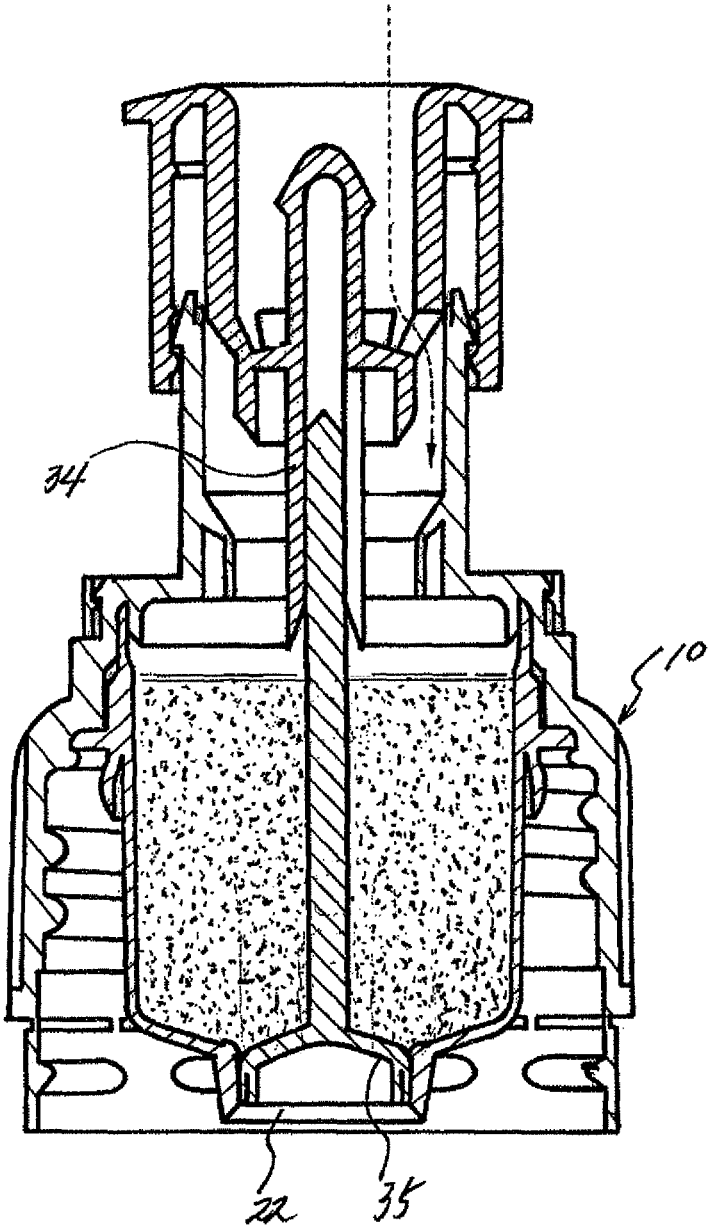
Figure 20:
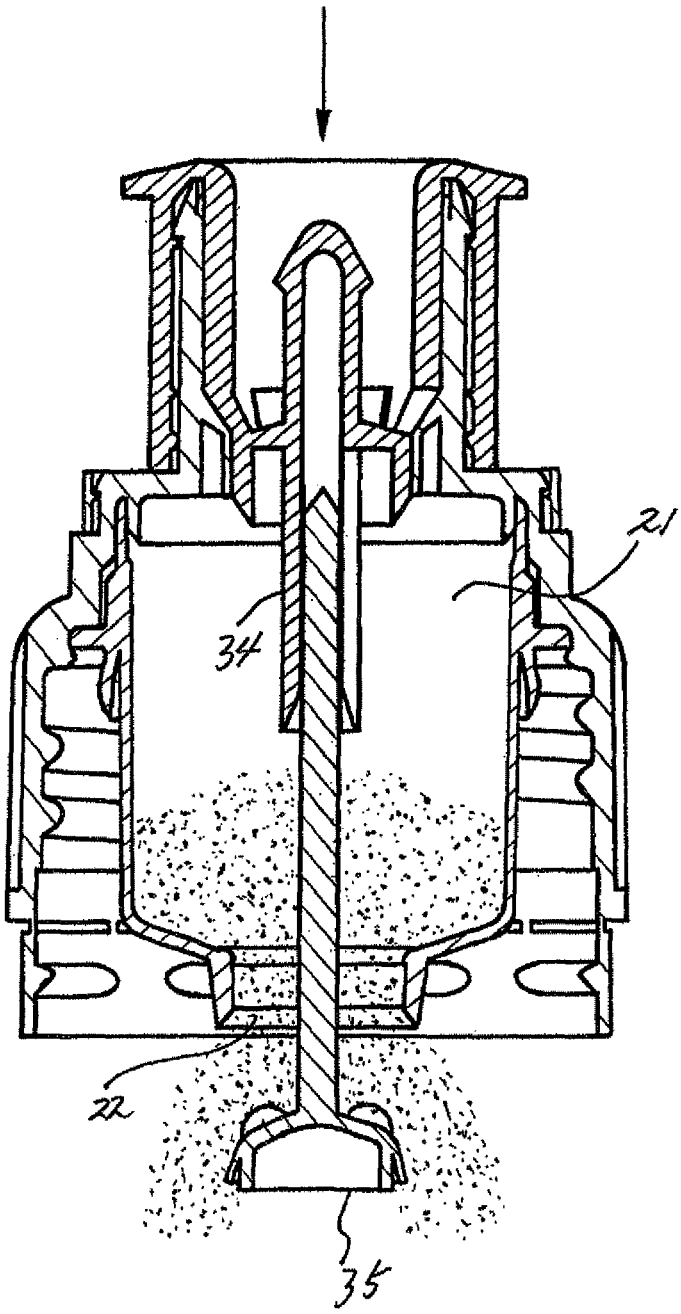

The FIGS. 18 thru 20 show an example when the closing section of opening and closing is transformed.

Figure 21:
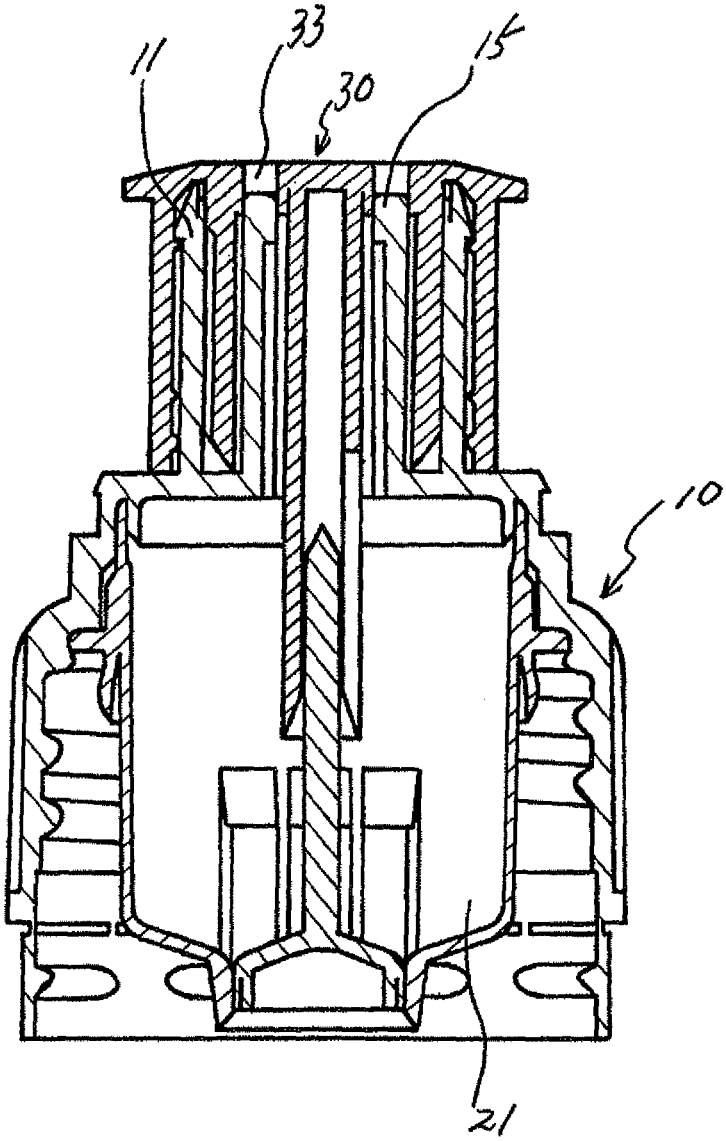

The FIG. 21 shows another example when the operating section is transformed.

Figure 22:
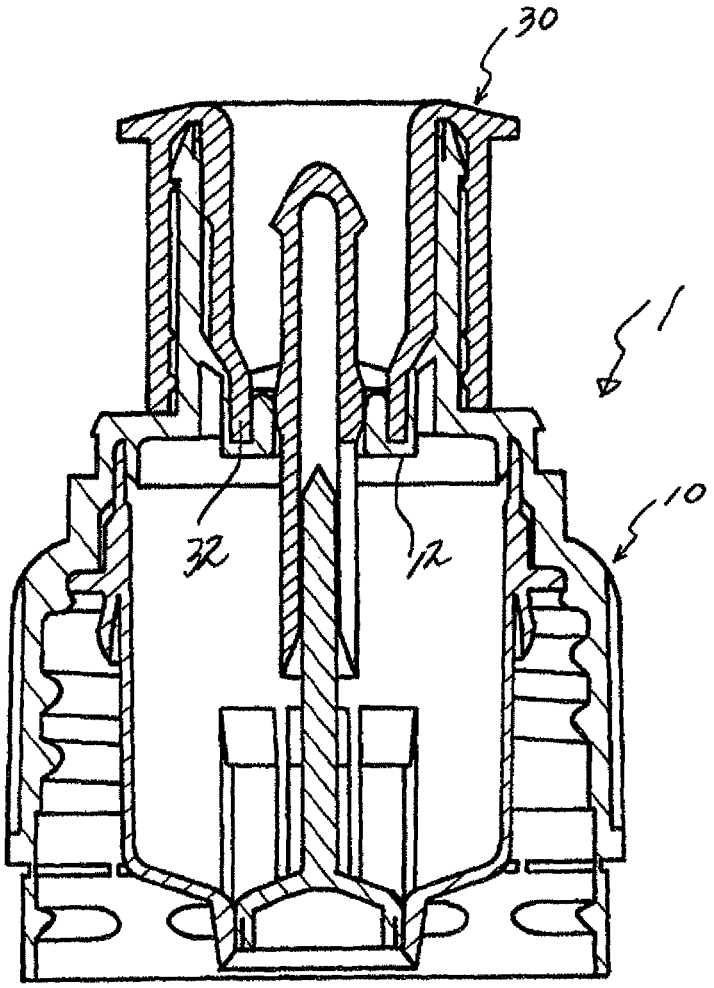
Figure 23:
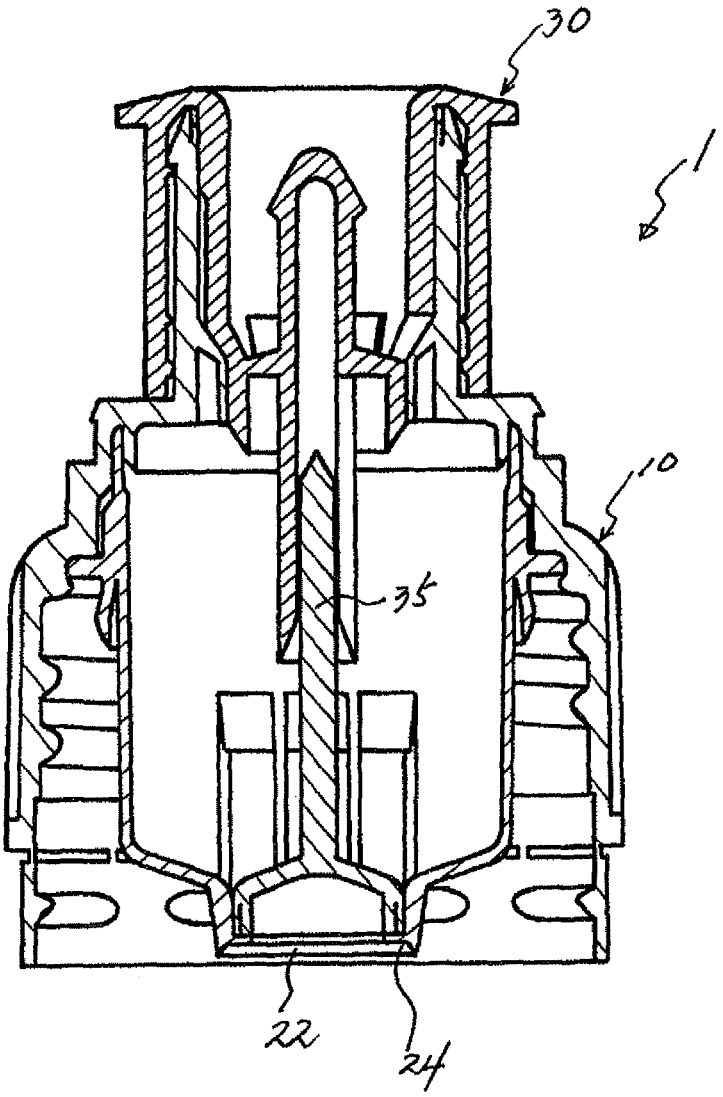

The FIGS. 22 and 23 show the other example when the operating section is transformed.

The FIGS. 24 thru 27 show the other operations of storage chamber for secondary material.

Figure 24:
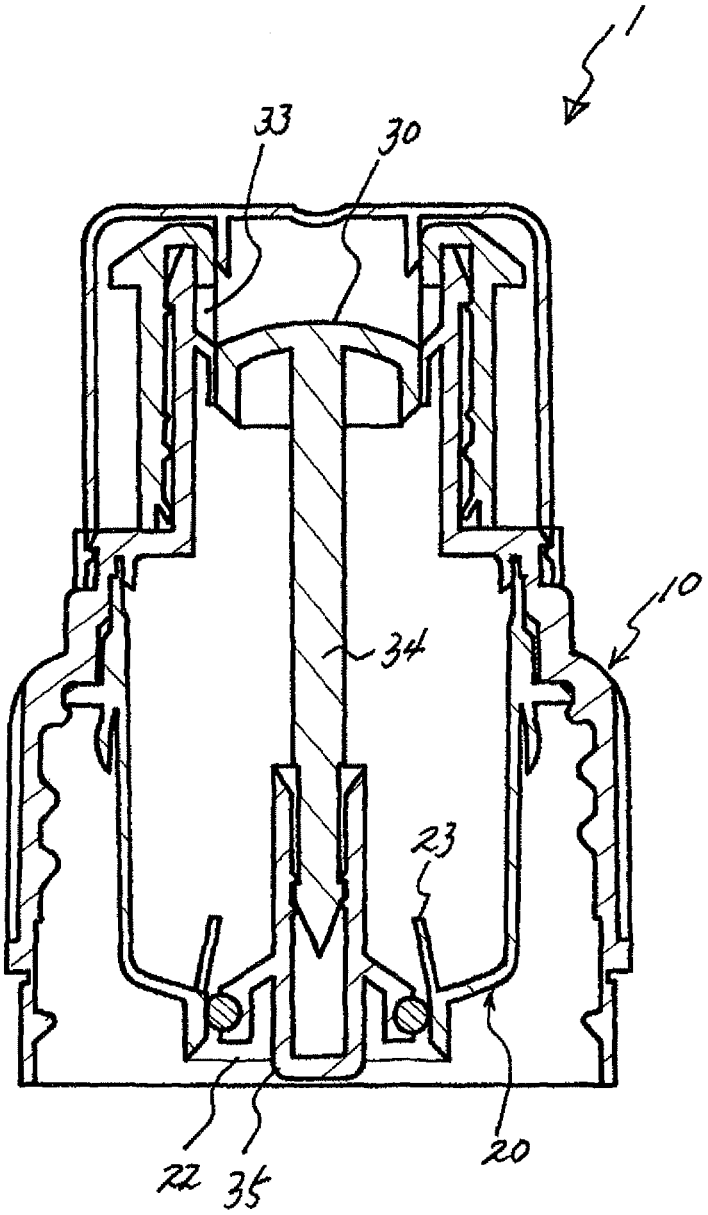

The FIG. 24 shows the sectional view.

Figure 25:
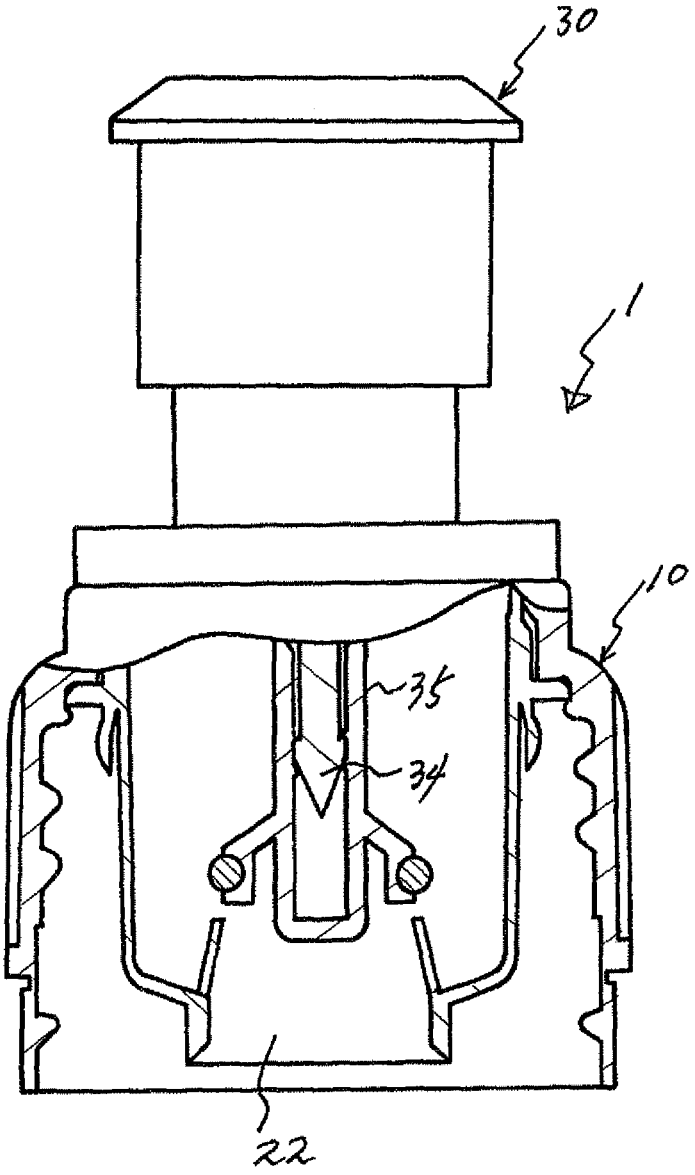

The FIG. 25 shows that the operating section is lifted.

Figure 26:
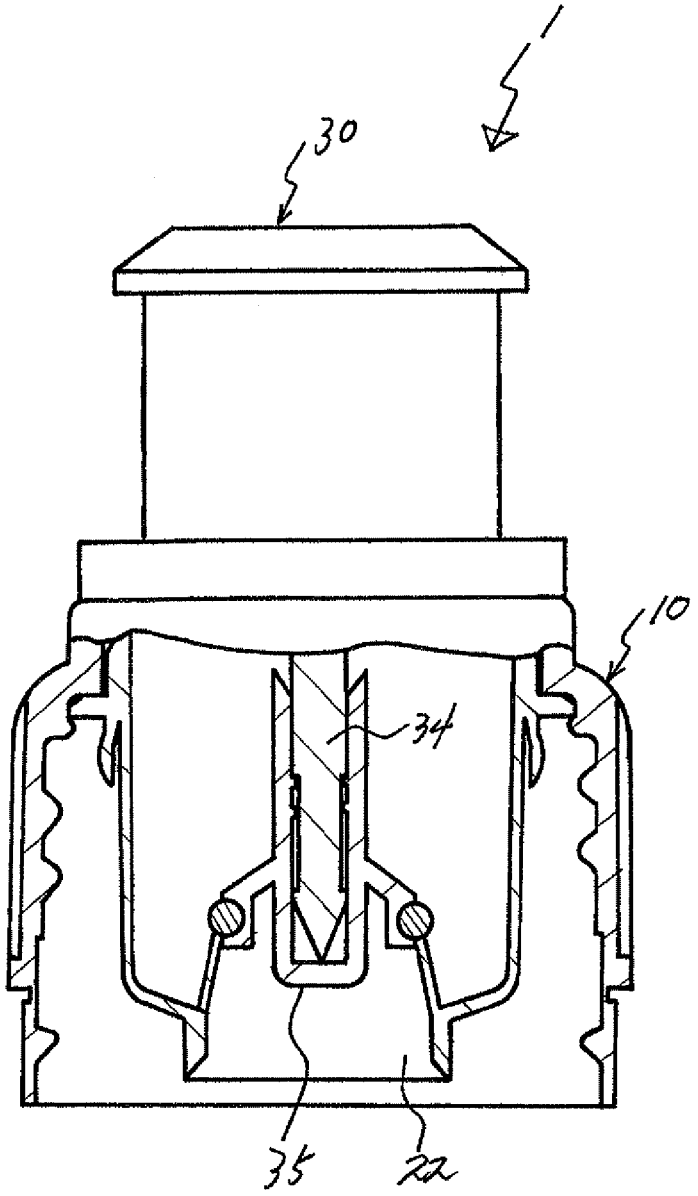

The FIG. 26 shows that the operating section returns to its original position.

Figure 27:
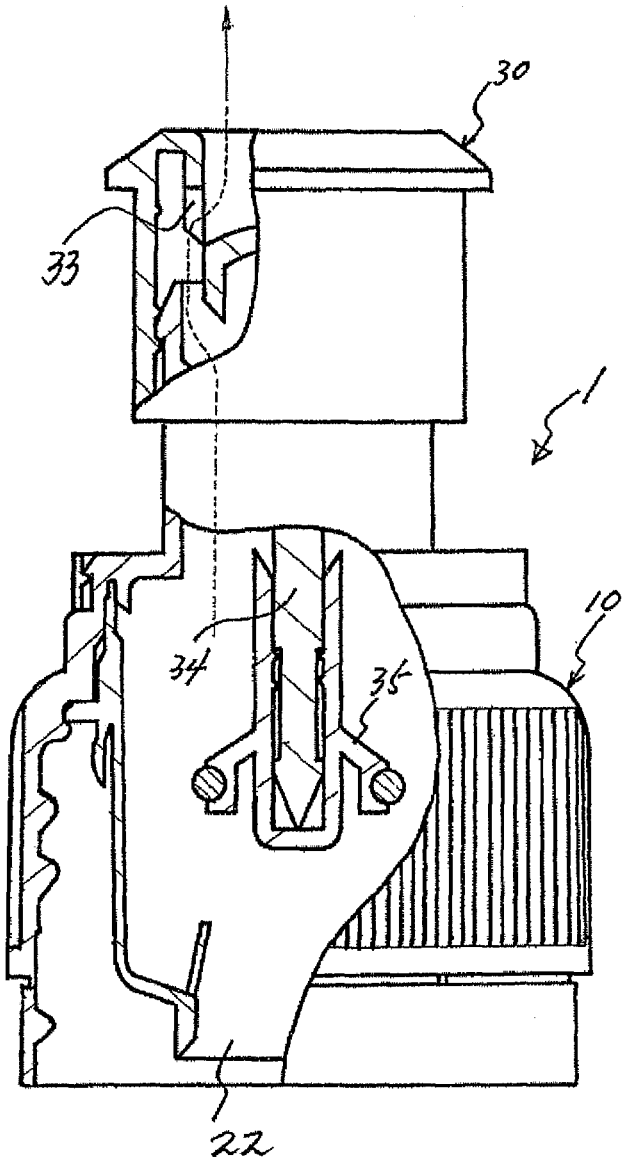

The FIG. 27 shows that the operating section is lifted again.

The FIGS. 28 thru 32 show the 4th operation of storage chamber for secondary material.

Figure 28:
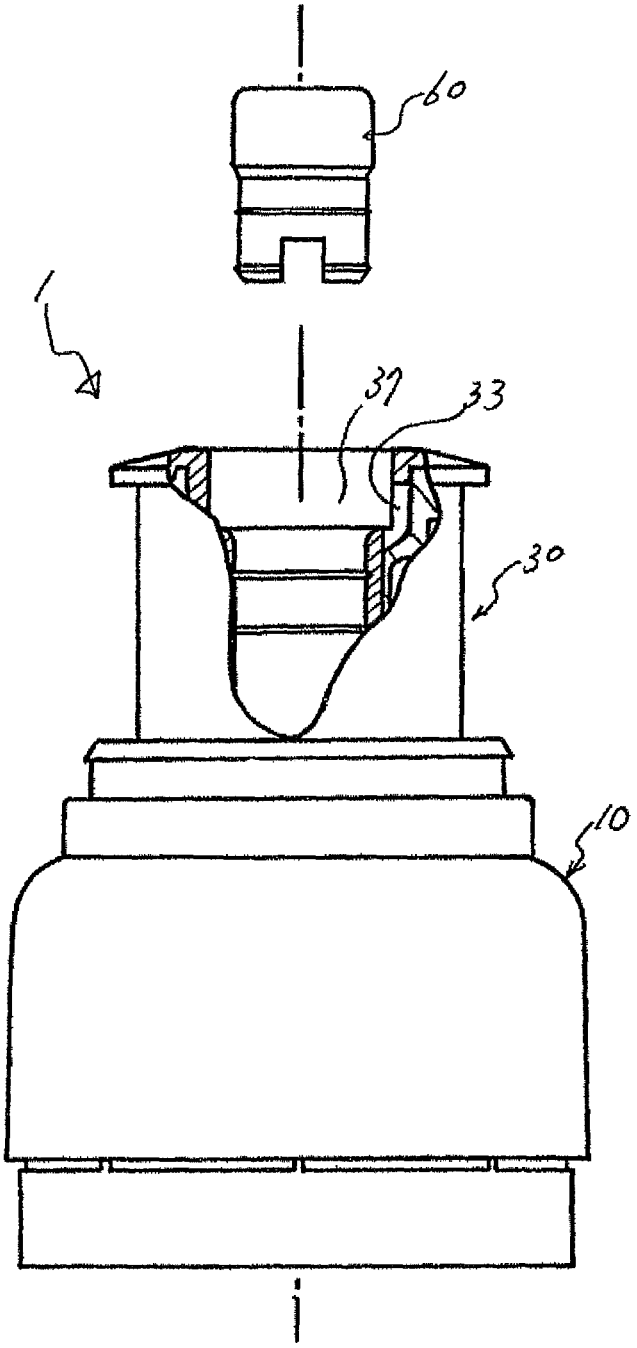

The FIG. 28 shows that closing section of operating section is opened.

Figure 29:
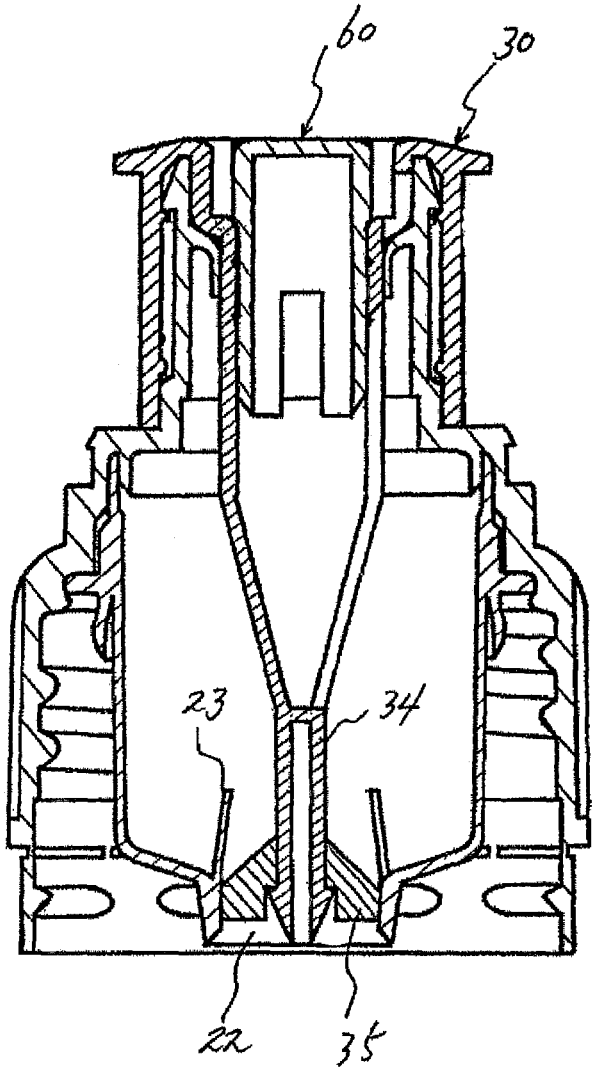

The FIG. 29 shows that the closing section of operating section is assembled.

Figure 30:
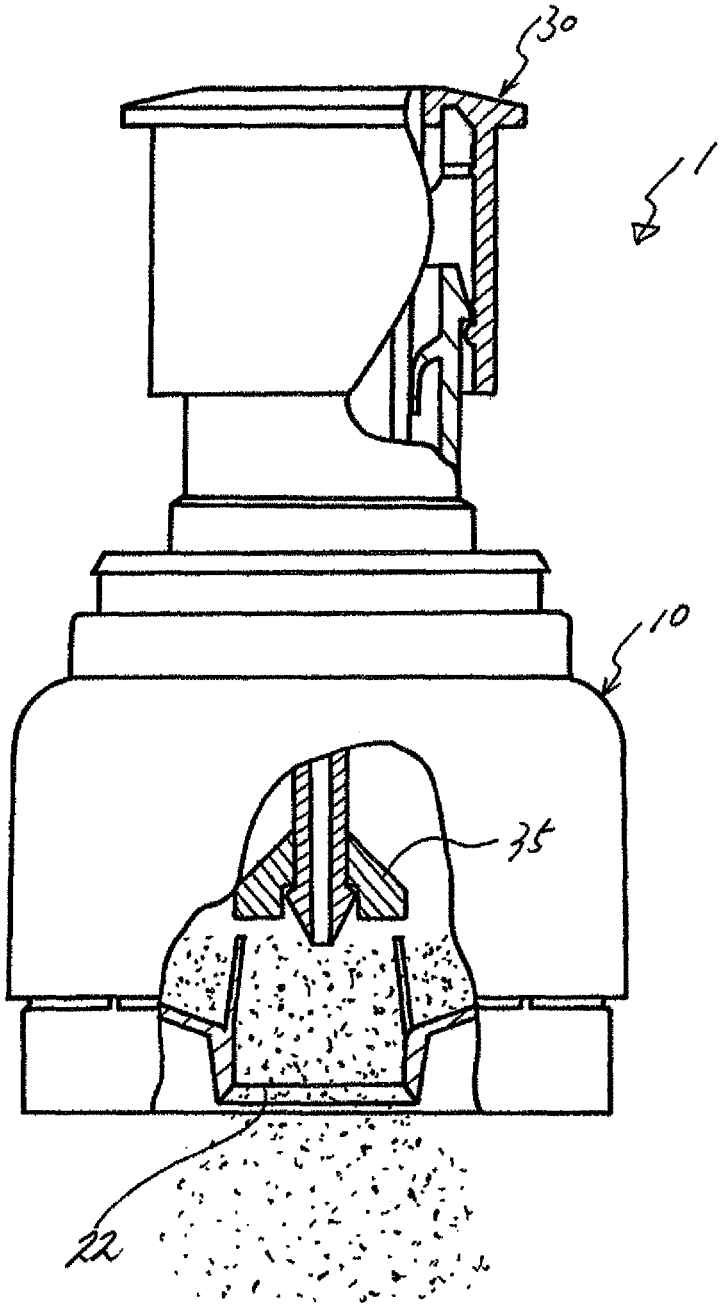

The FIG. 30 shows that the opening and closing hole is opened.

Figure 31:
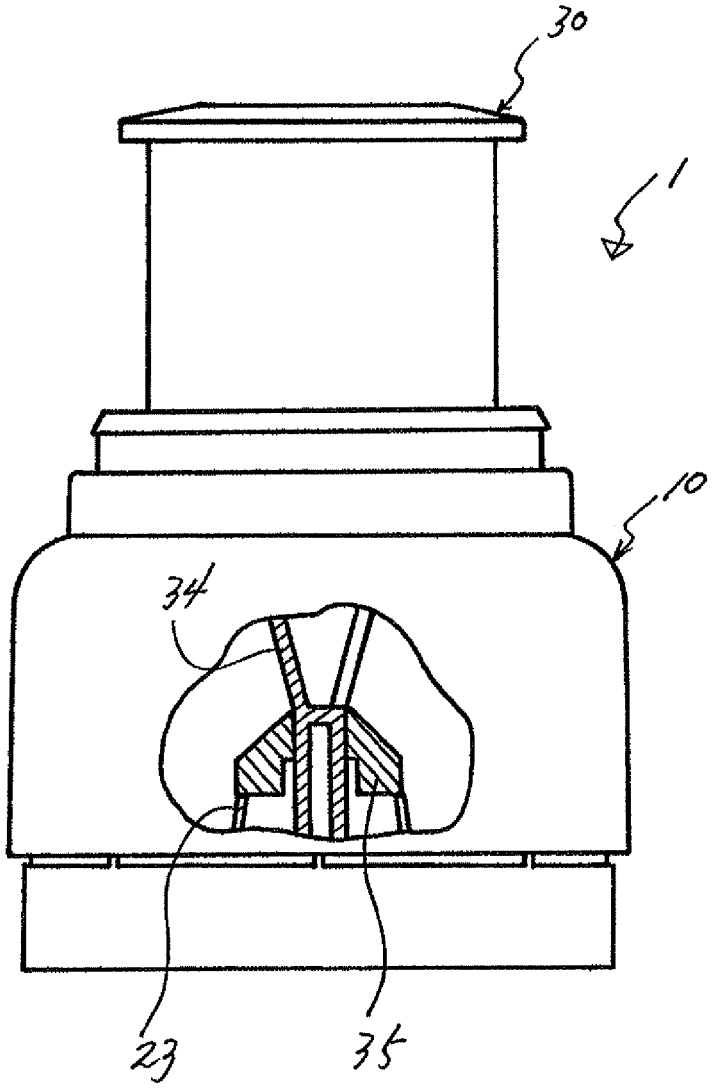

The FIG. 31 shows that the opening and closing hole is opened when the operating section returns to its original position.

Figure 32:
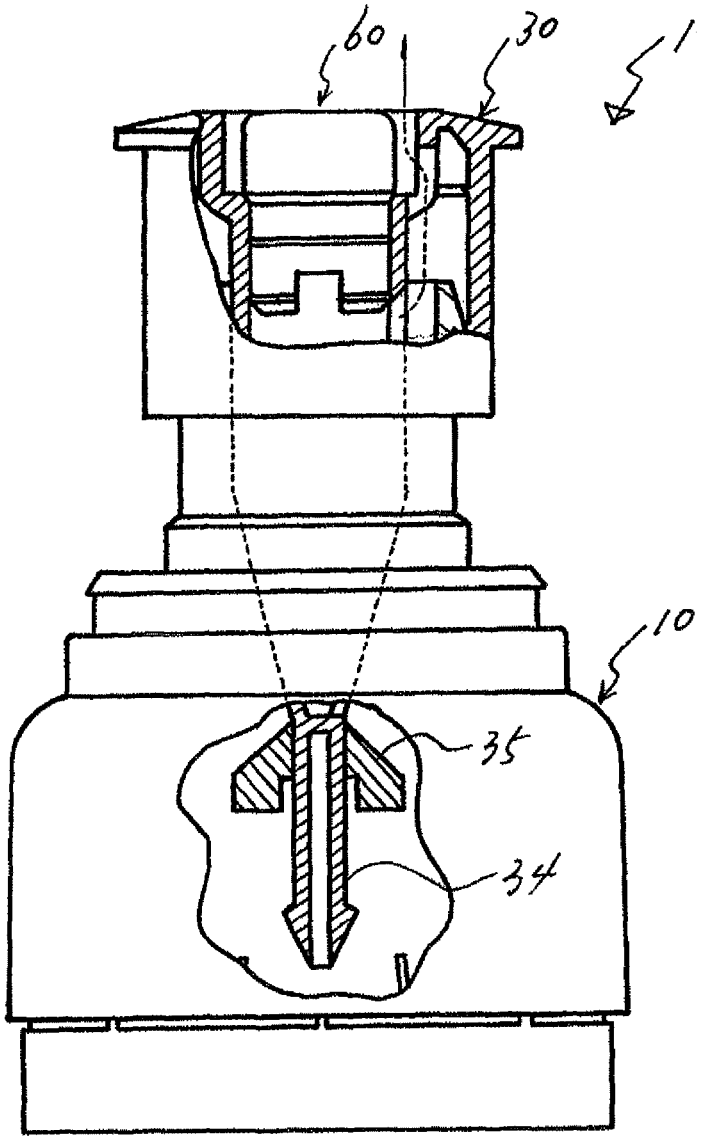

The FIG. 32 shows that the operating section is opened under condition specified in the FIG. 31.

The FIGS. 33 thru 42 show the 5th operation of this invention.

Figure 33:
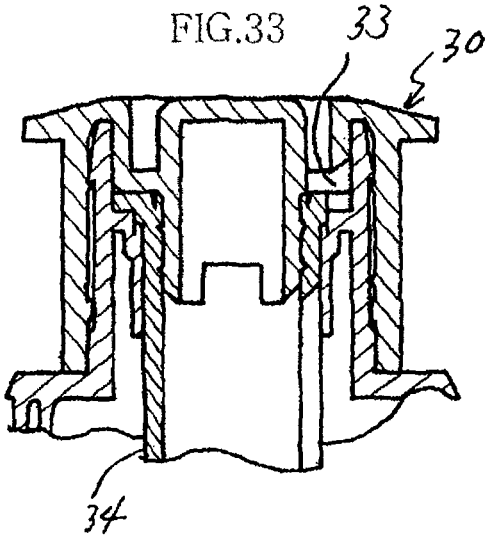

The FIG. 33 shows the sectional view of area where the operating section is assembled.

Figure 34:
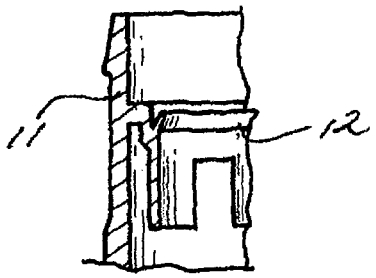

The FIG. 34 is a sectional view showing the globe of body

Figure 35:
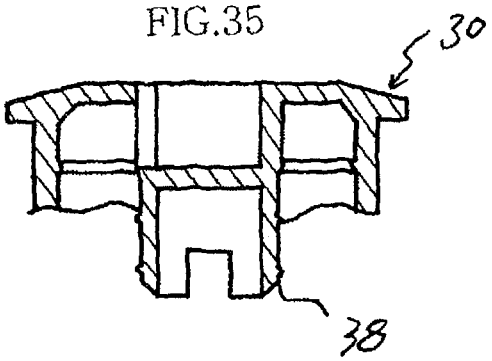

The FIG. 35 is a sectional view showing the important parts of opening section.

Figure 36:
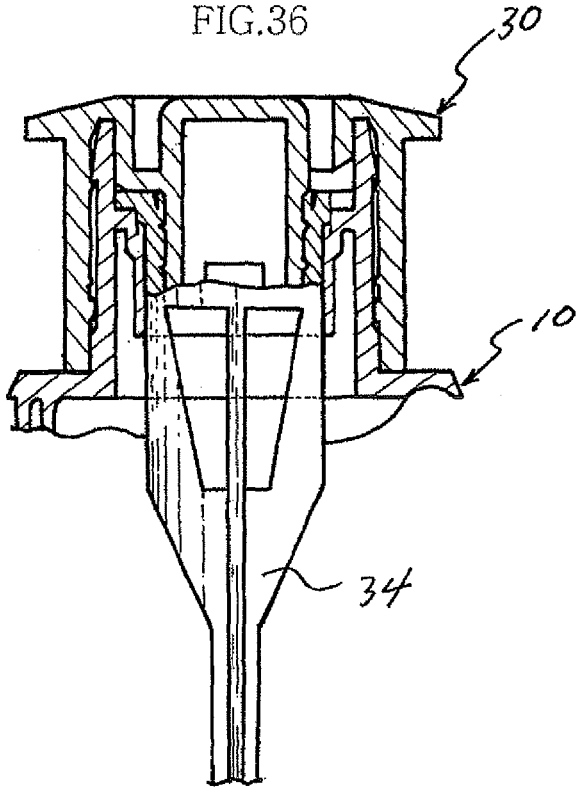

The FIG. 36 shows that the connecting rod is connected to the operating section.

Figure 37:
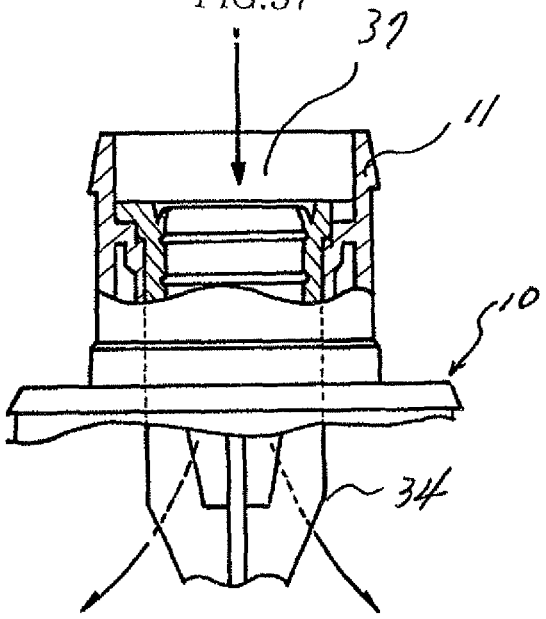

The FIG. 37 shows an example when the operating section is transformed.

Figure 38:
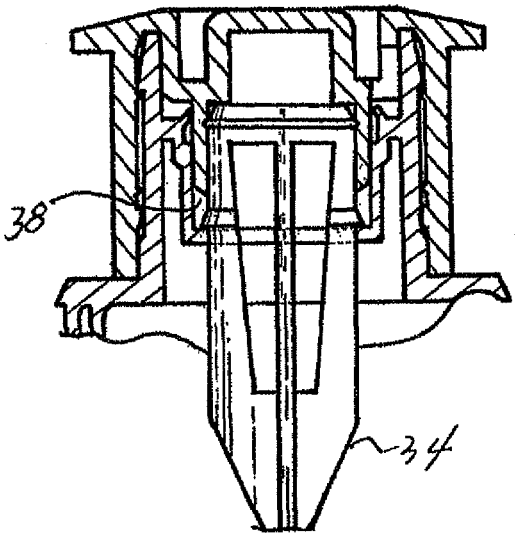

The FIG. 38 shows another example when the operating section is transformed.

Figure 39:
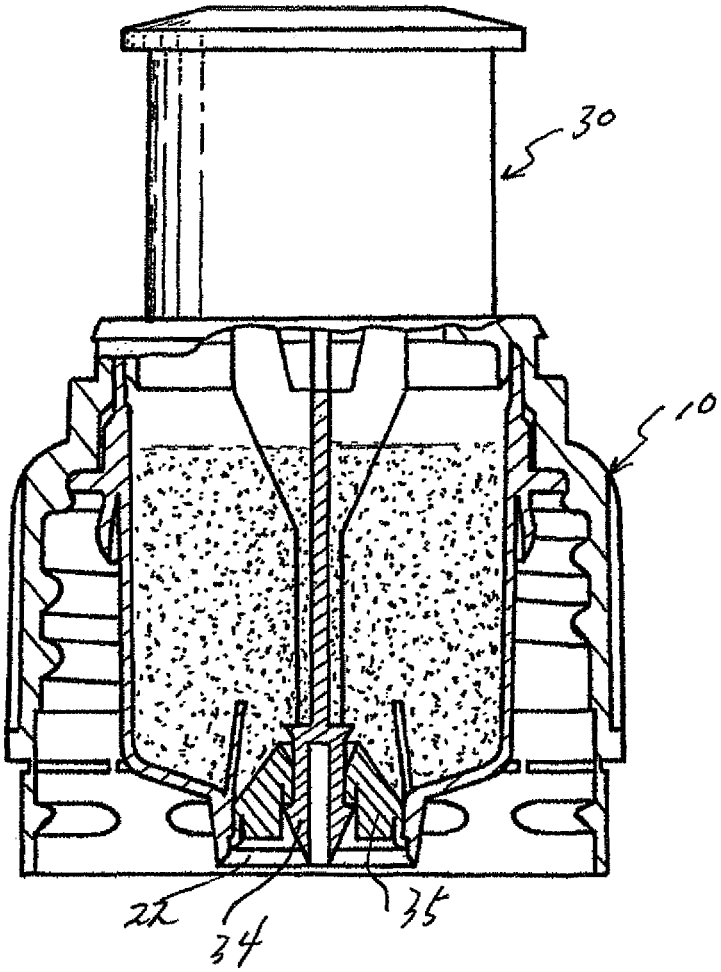

The FIG. 39 shows an example when the closing section of opening and closing hole is transformed.

Figure 40:
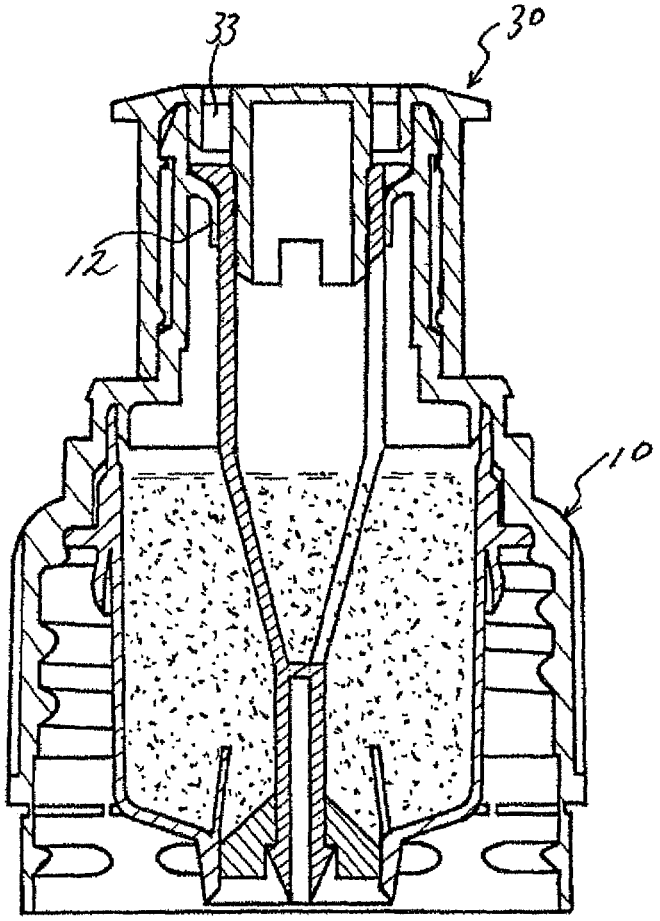

The FIG. 40 shows another example of transformed closing section of opening and closing hole.

Figure 41:
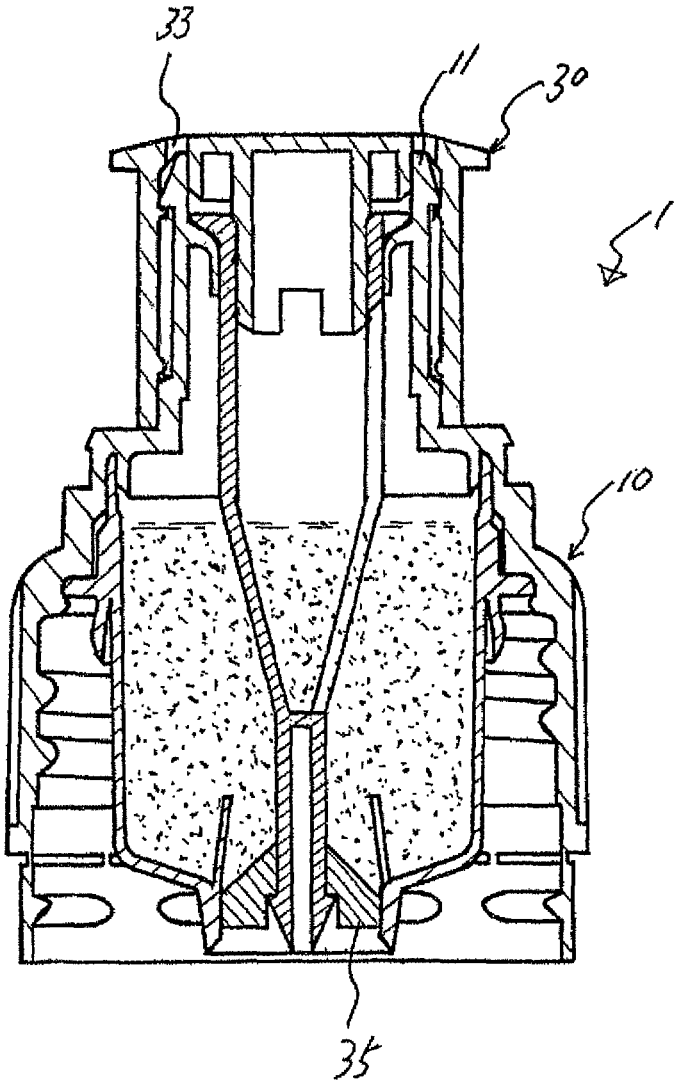

The FIG. 41 shows another example when the operating section is transformed.

Figure 42:
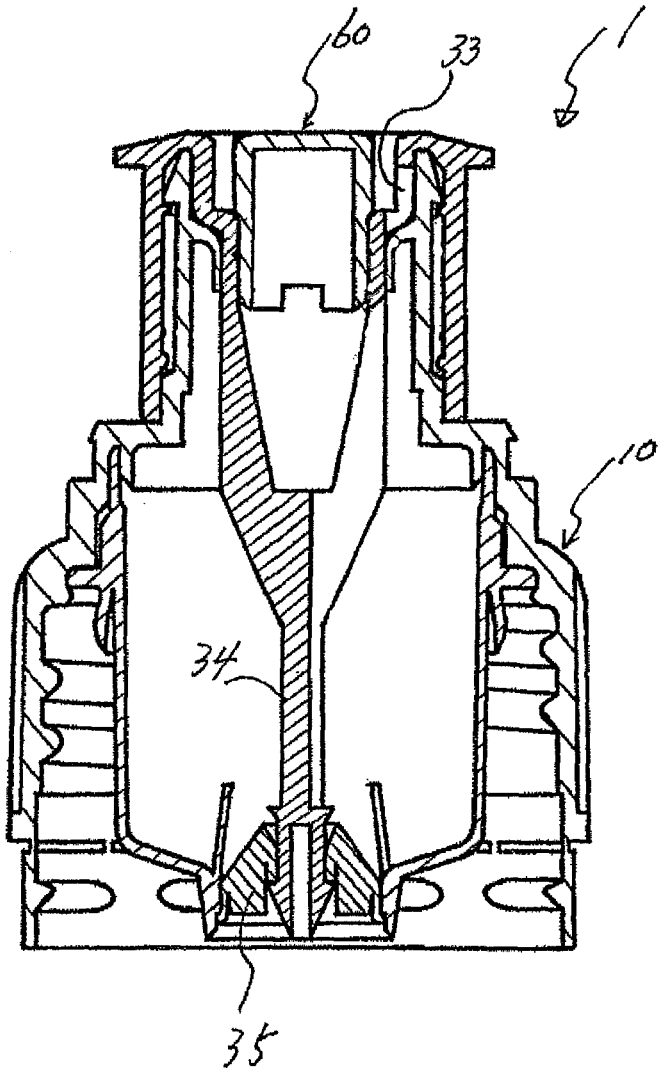

The FIG. 42 shows other example when the operating section is transformed.

The FIGS. 43 thru 51 show the 6th operation of this invention.

Figure 43:
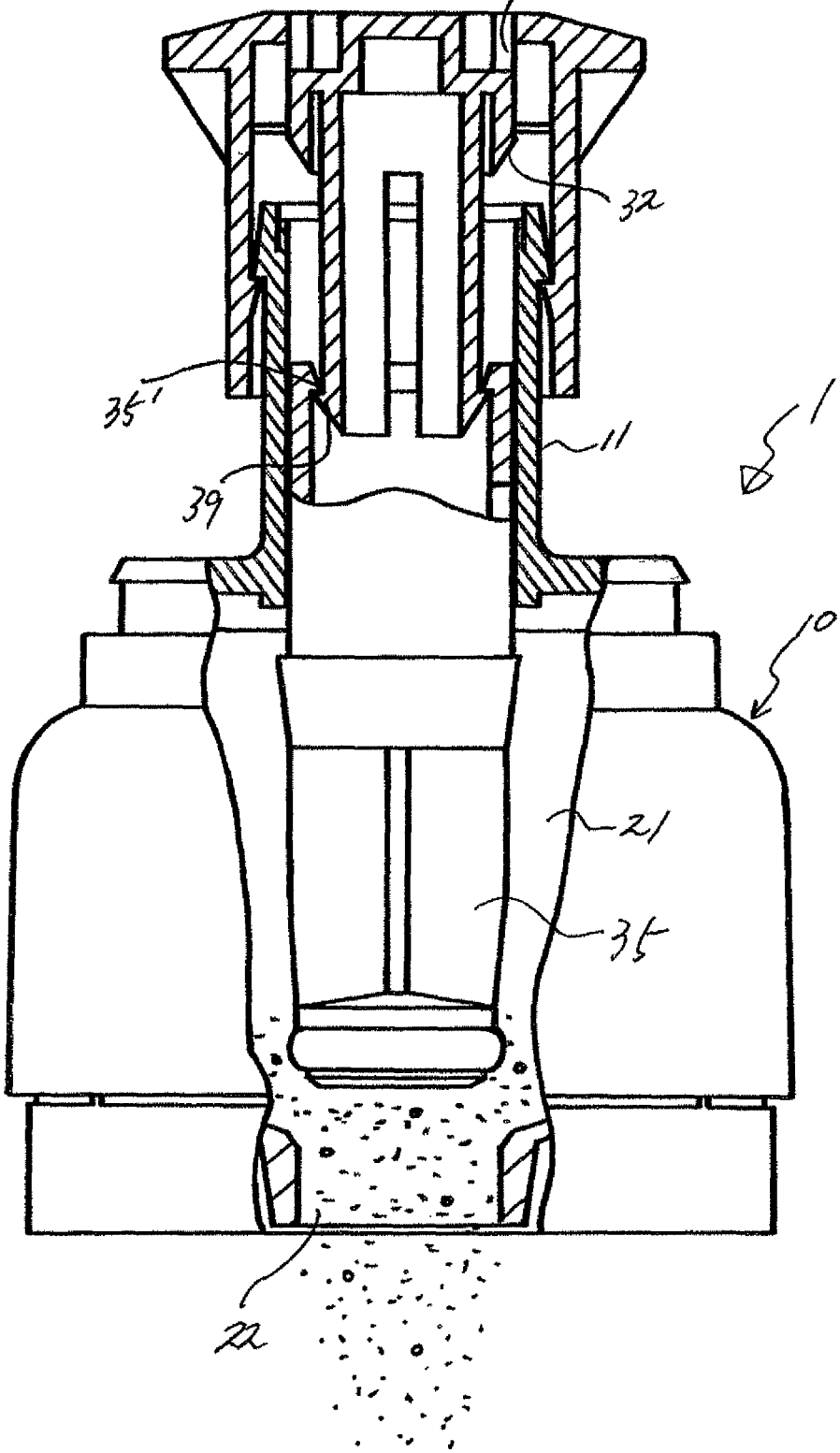

The FIG. 43 shows that the closing section of opening and closing hole is opened.

Figure 44:
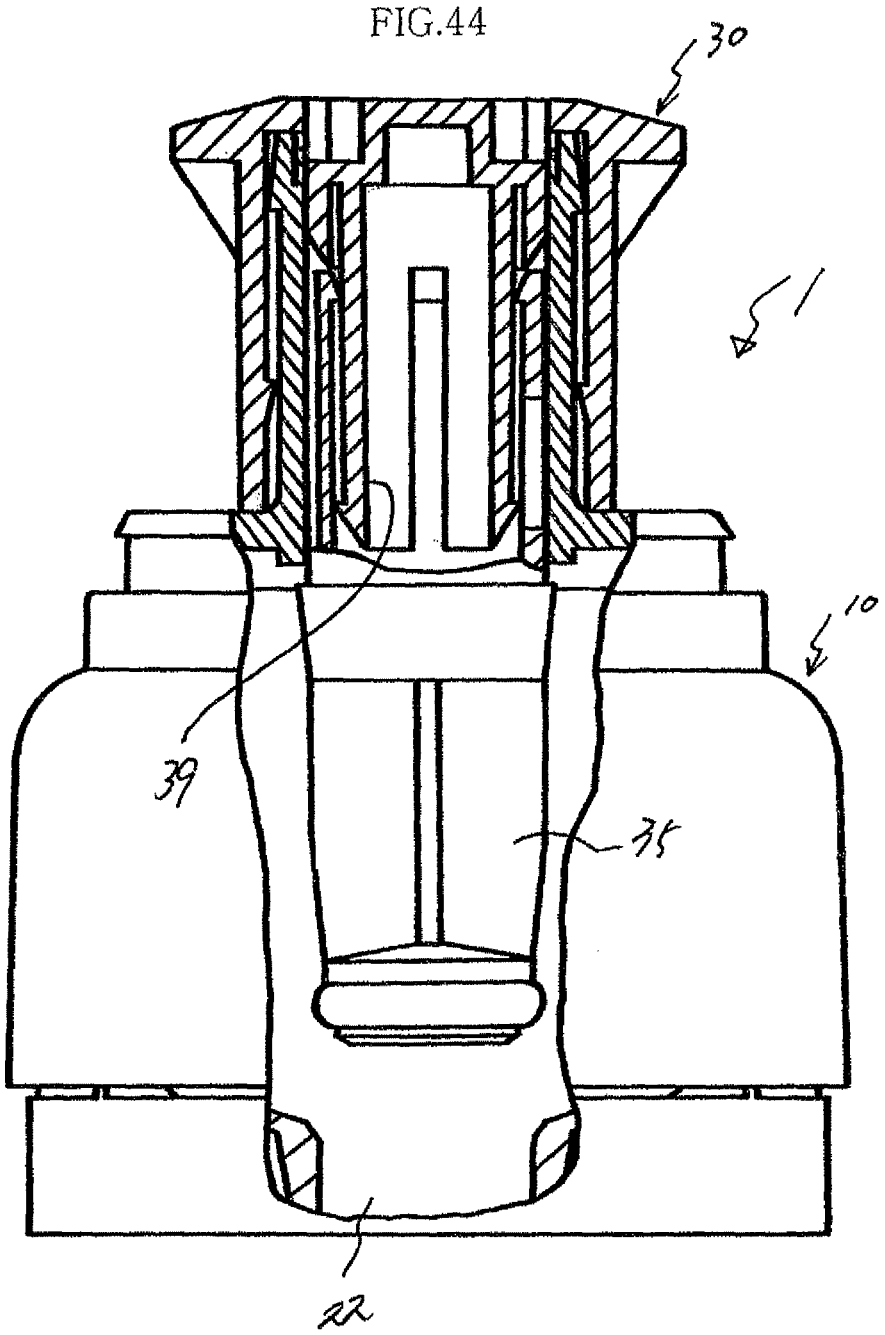

The FIG. 44 shows that the operating section is closed under the condition specified in the FIG. 43.

Figure 45:
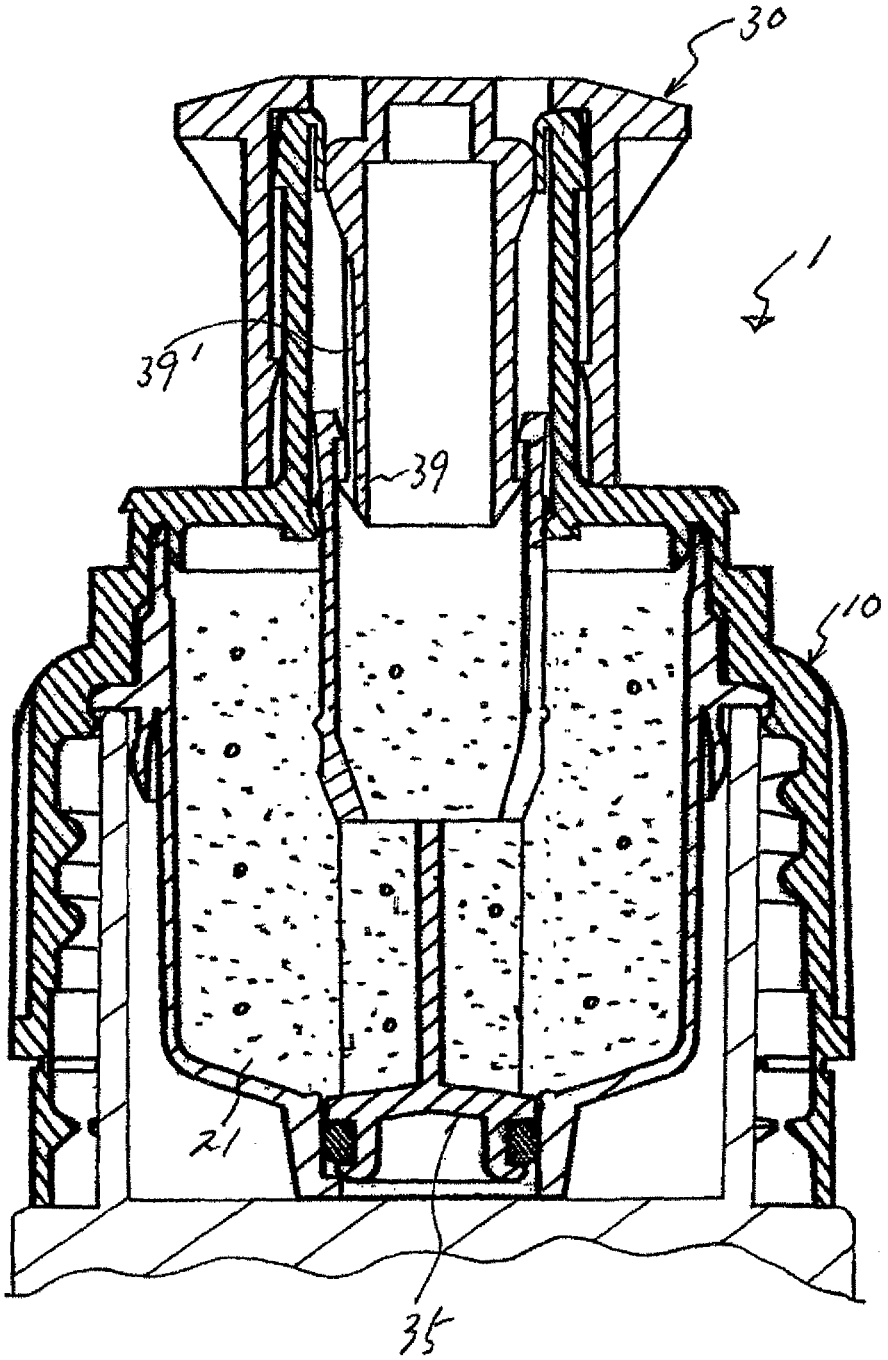

The FIG. 45 shows an example when the operating section is transformed.

Figure 46:
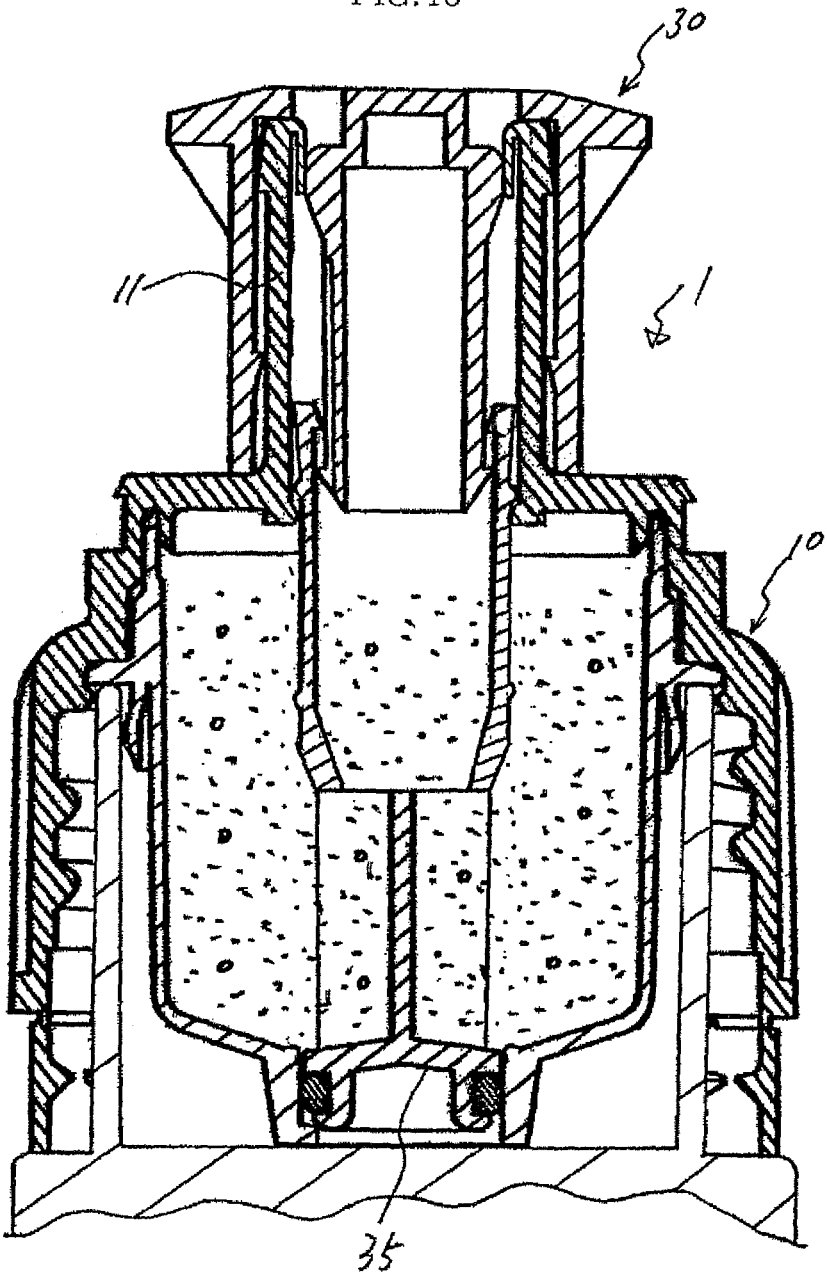

The FIG. 46 shows an example when the closing section of opening and closing hole is transformed.

Figure 47:
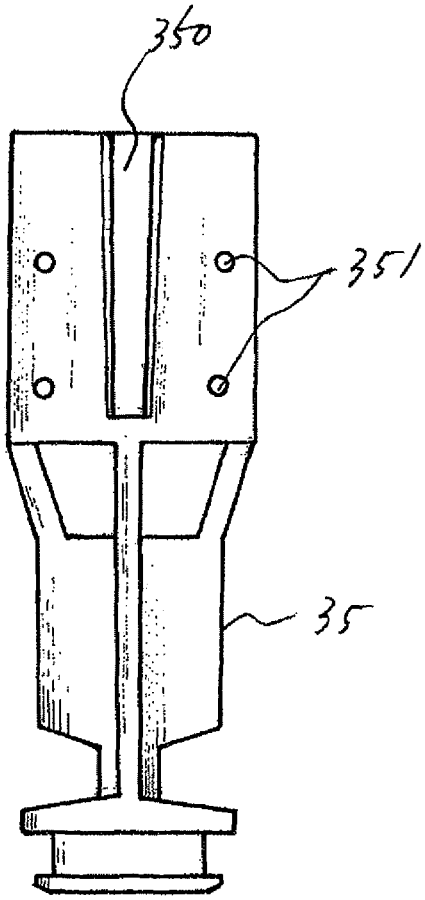

The FIG. 47 shows an operating state of closing section of opening and closing hole.

Figure 48:
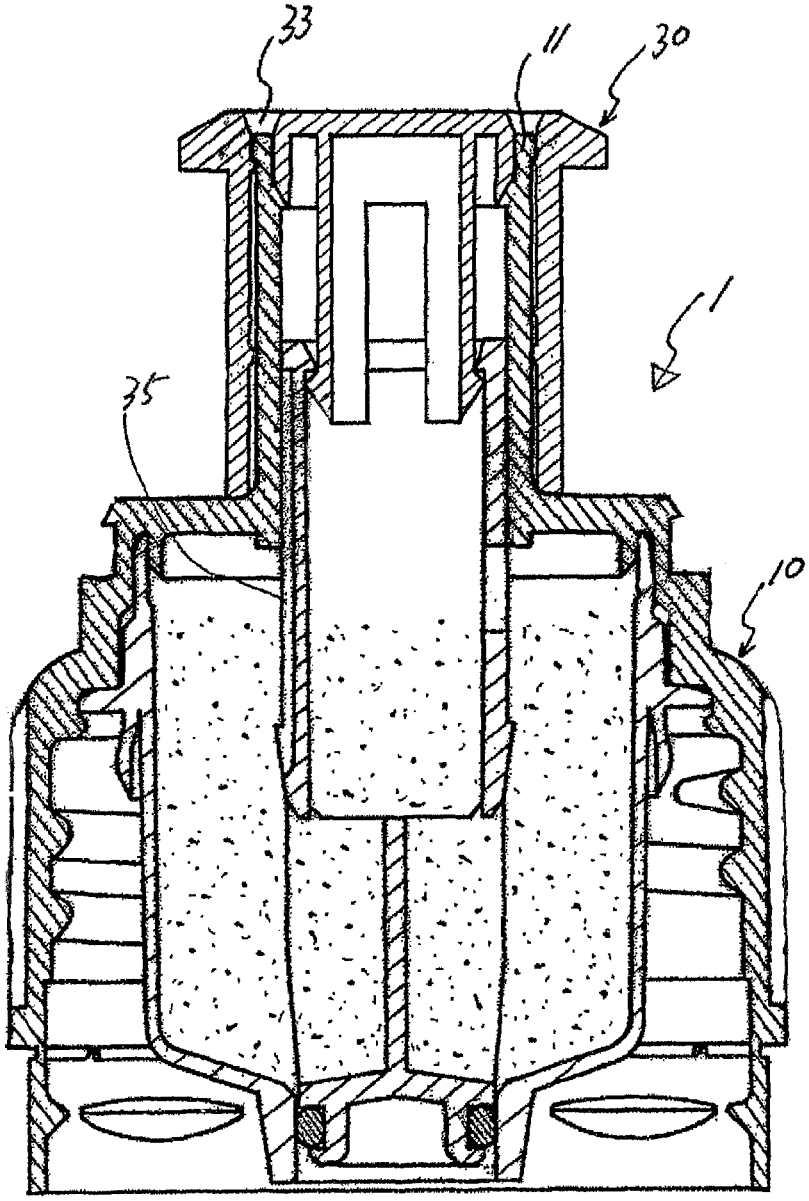

The FIG. 48 shows an example when the operating section is transformed.

Figure 49:
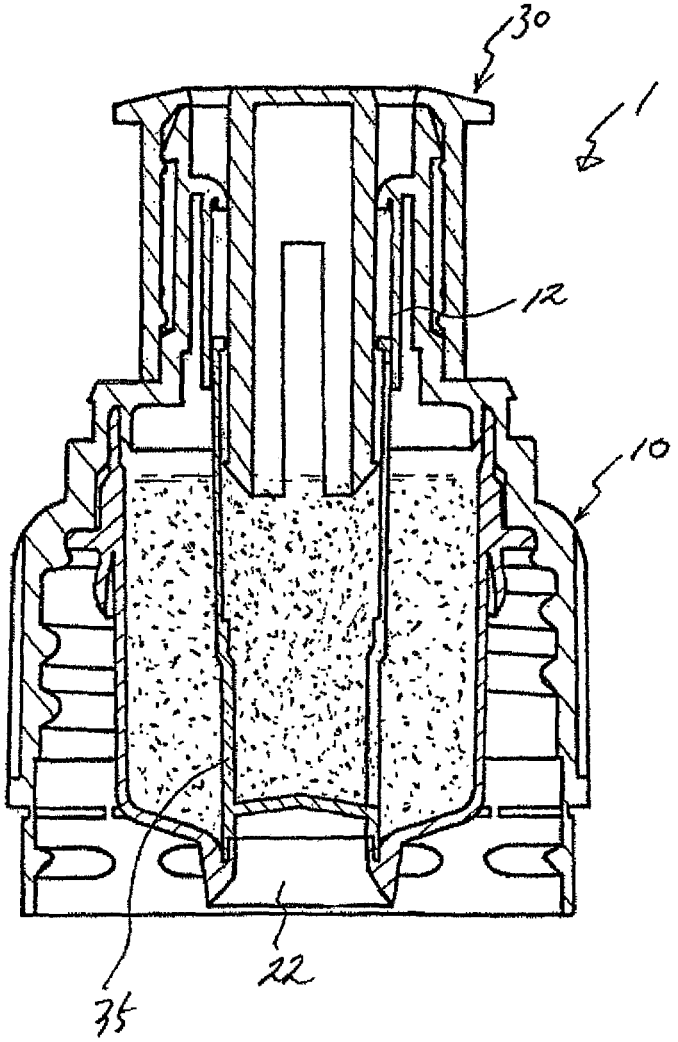

The FIG. 49 shows another example when the operating section is transformed.

Figure 50:
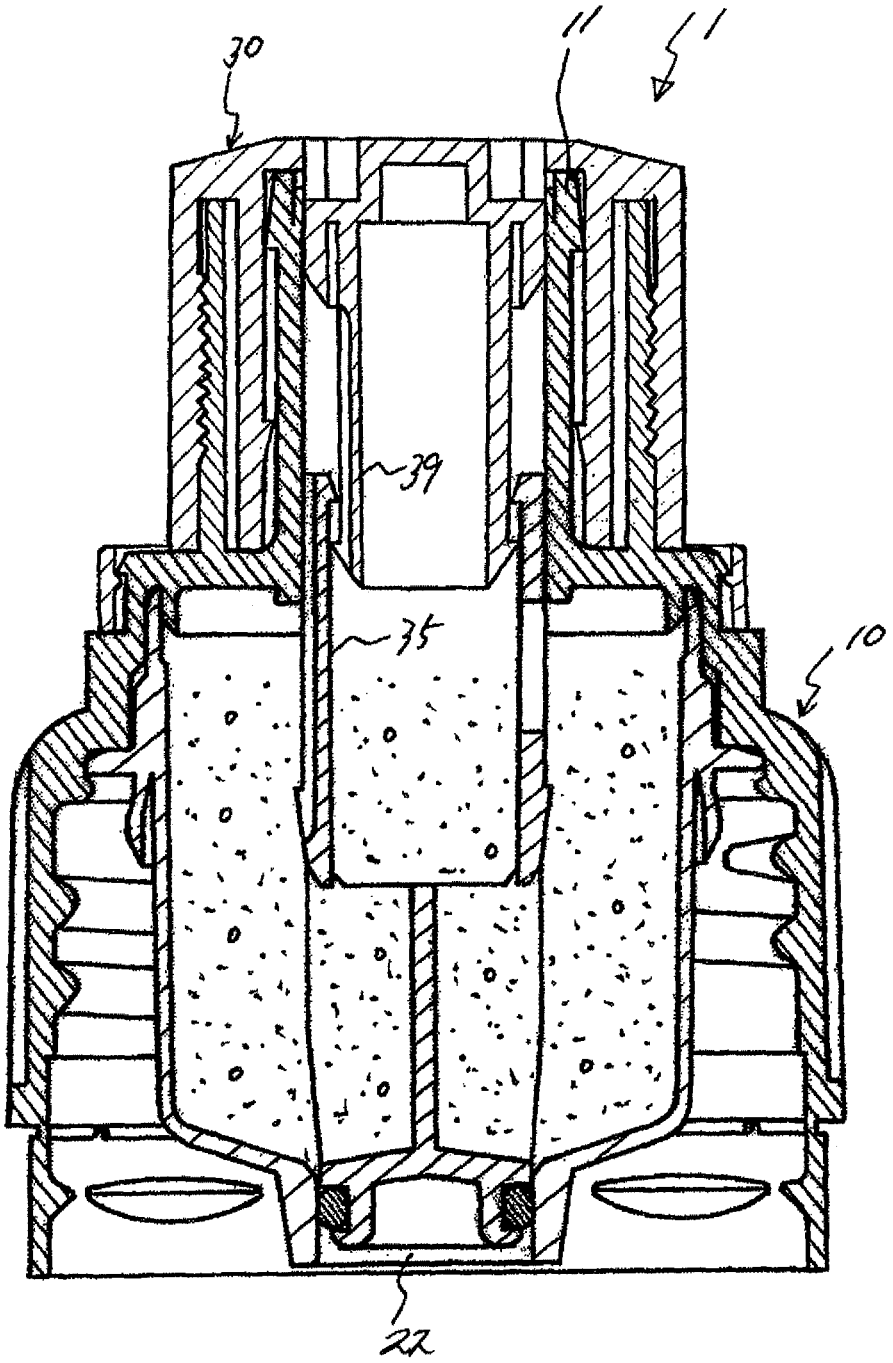

The FIG. 50 shows other example when the operating section is transformed.

Figure 51:
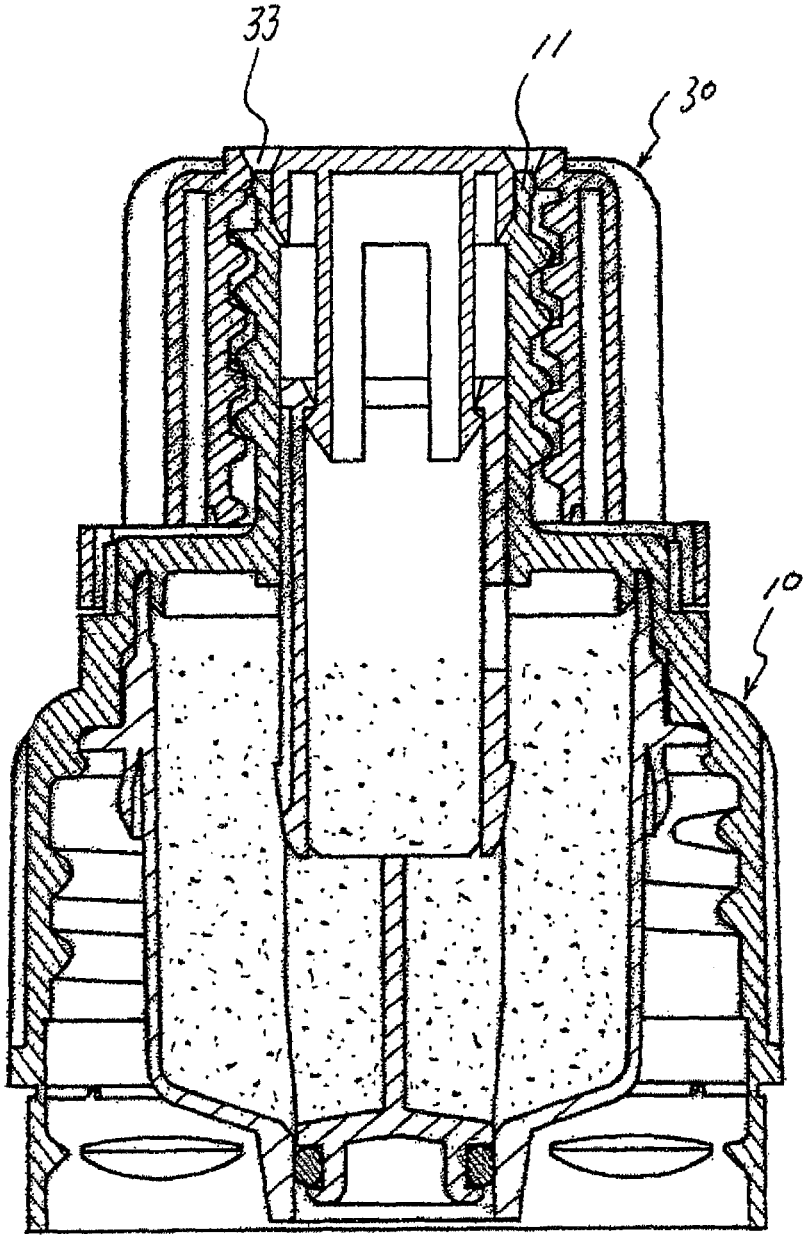

The FIG. 51 shows other example when the operating section is transformed.

Figure 52:
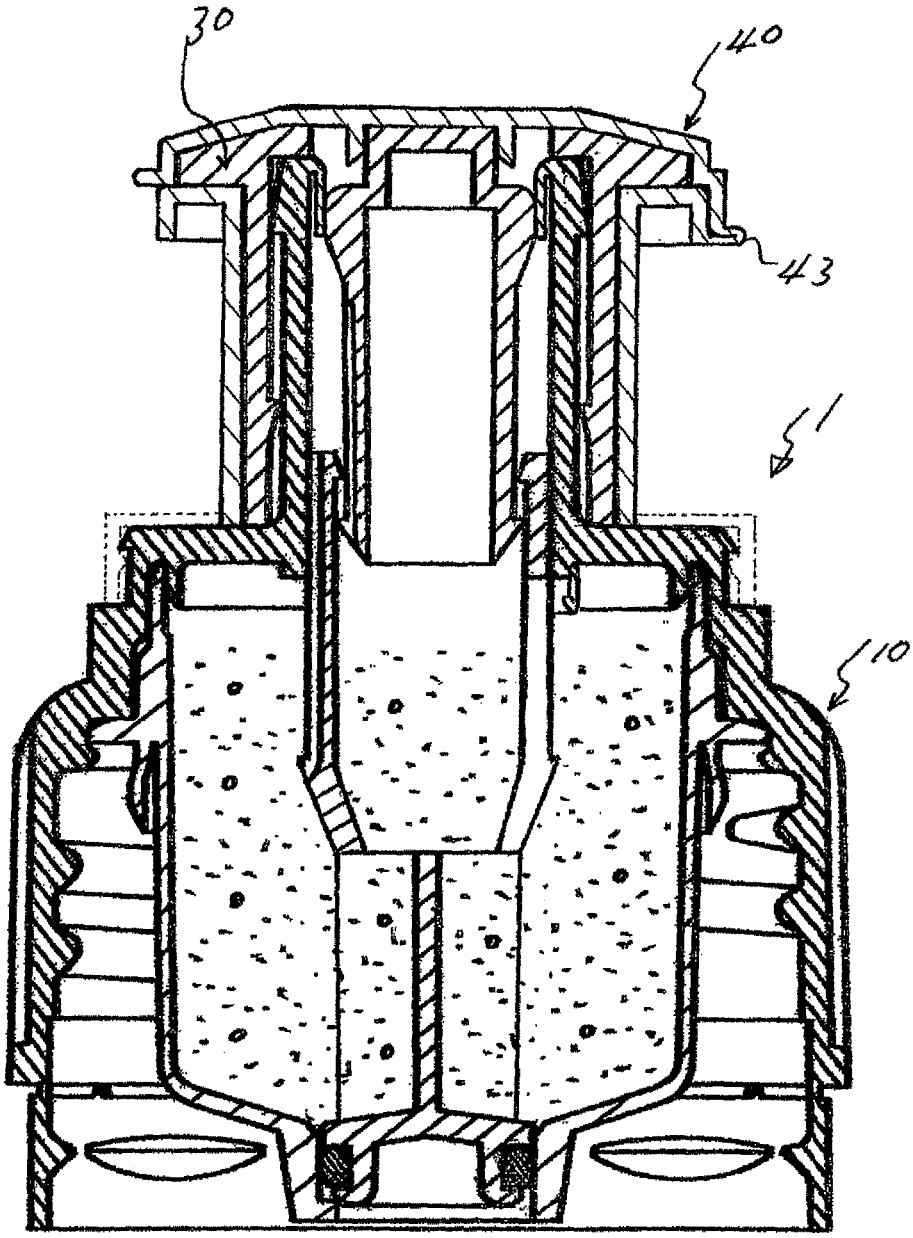

The FIG. 52 shows the 7th operation of storage chamber for secondary material. Also, this figure shows that the cover is assembled in the operating section.

Figure 53:
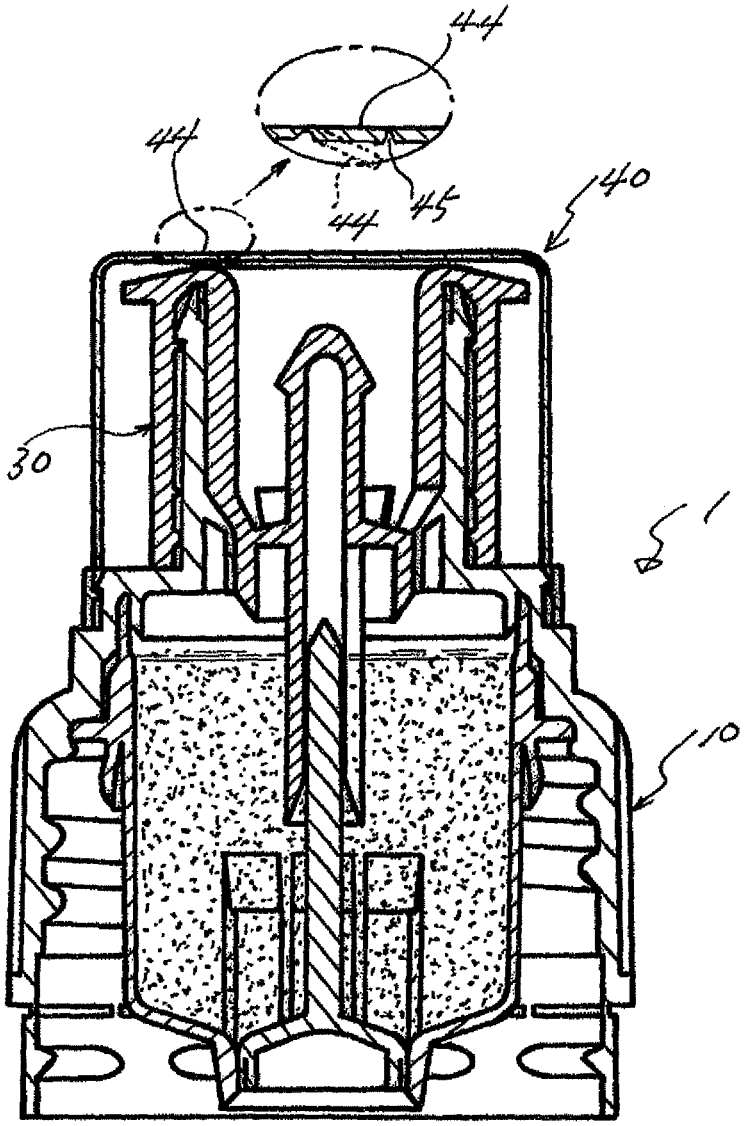

The FIG. 53 shows the 8th operation of this invention. Also, this figure shows that the air inlet is fixed to the cover.

BEST MODE FOR CARRYING OUT THE INVENTION

Figure 1:
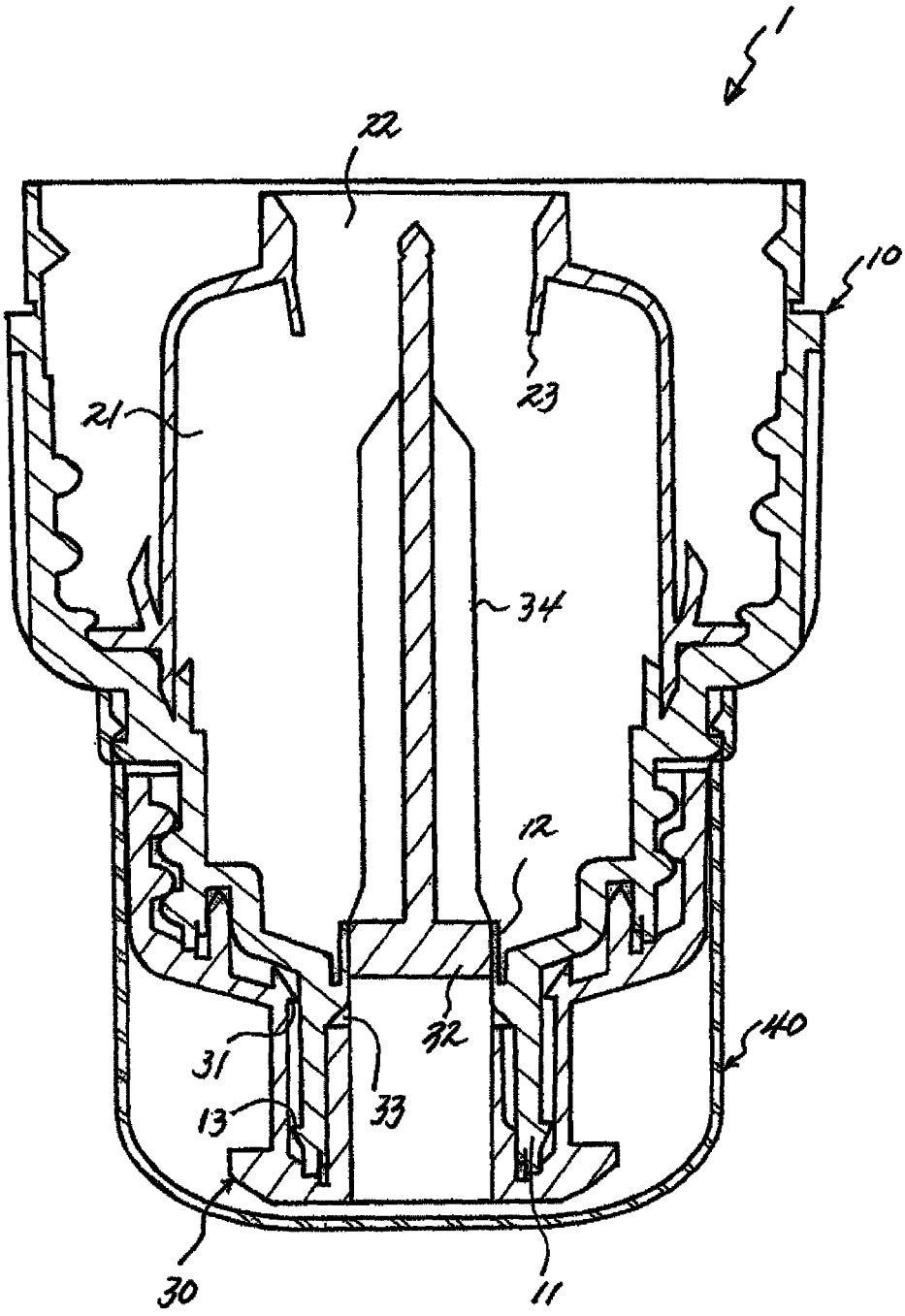

The operation examples of this invention recommended according to enclosed drawings or figures are as follows:

The FIG. 1 shows a recommended operation example of this invention. The storage of this invention (1) is combined in the container by the screws or one-touch method or adhesives. You may optionally separate the storage (1) from the container (100).

Fix the receiving section (20) with storage space (21) and opening and closing hole (22) to the body (10) through the assembling process and fix the globe (11) and closing section (35) on the top of body (10) and then assemble the operating section (30) playing the role of closing the opening and closing hole (22) of receiving section (20) around the globe (11).

Above operating section (30) is selectively opened and closed either by being rotated or lifted on the globe (11). The FIG. 1 shows the recommended opening and closing example when lifted. The globe catching jaw (13) and operating section catching jaw (31) play the role of preventing the operating section (30) from being separated from the globe (11) within the specific range.

Also, above storage (1) enables the closing side (32) of operating section (30) to contact the closing side (12) of globe (11) via a boring (30) section (14) when the operating section (30) is assembled in the body (10). Position the closing section (35) of opening and closing hole (22) on the bottom of extension section (34) extended from the closing side (32) of operating section (30). However, position the closing section (35) of opening and closing hole (22) in the opening and closing hole (22) so that the perfect airtight may be guaranteed for the contents stored in the storage space (21) of receiving section (20).

It is available to assemble the cover (40) on the top of operating section (30) after filling the contents in the storage space (21) via a boring section (14) of above body (10).

Place the vent (33) on the top of closing side (32) of operating section (30) so that the storage space (21) may be connected to the exterior area when the operating section (30) moves up.

The storage (1) of this invention enables the closing side (32) of operating section (30) to be separated from the closing side (12) of globe (11) when the operating section (30) is separated from the globe (11) of body (10) if the operating section (30) moves up.

If you apply the pressure against the container (100) with inclined, contents stored in the container (100) are discharged via an opening and closing hole (22) and vent (33).

On the other hand, closing section (35) of opening and closing hole (22) is separated from the opening and closing hole (22) and then contents stored in the storage space (21) are mixed with contents stored in the container (100) after being dropped when above operating section (30) moves up.

As the recommended example, the FIG. 2 shows that the contents are filled via a opening and closing hole (22) under the condition specified in the FIG. 1.

If the closing section (35) of opening and closing hole (22) is assembled in the opening and closing hole (22) under the condition specified in the FIG. 2, closing section (35) of opening and closing hole (22) is combined around the extension section (34).

The FIG. 4 shows that the assembled storage is completely fixed to the container.

The FIG. 5 shows that the contents stored in the storage space (21) are dropped and mixed in the container (100) via a opening and closing hole (22) when the operating section (30) is lifted.

The FIG. 6 shows that the operating closing section (36) is separated by the removal rack (23) mounted on the top of opening and closing hole (22) of receiving section (20) and then opening and closing hole (22) is opened again when the operating section (30) moves down again.

The contents mixed in the container (100) are discharged via a vent (33) operated when the operating section (30) is opened, and if you move down the operating section (30), closing side (32) of operating section (30) contacts the closing side (12) of globe (11), so the vent (33) is closed.

As shown in the FIG. 7, as other operating (FIG. 7 thru 23), closing side (32) of operating section (30) designed as the wing type is installed on the bottom of vent (33) for the reinforcement of airtight. The closing side (32) of opening and closing hole (22) is installed around the interior or exterior hole of extension section (34) as shown in the FIG. 8.

The FIG. 8 shows that the contents are filled via an opening and closing hole (22) and closing section (35) of opening and closing hole (22) is assembled around the extension section (34) under the condition specified in the FIG. 7.

The FIG. 9 shows that the closing section (35) of opening and closing hole (22) is separated from the opening and closing hole (22) when the operating section (30) is lifted under the condition specified in the FIG. 8. At this time, the contents stored in the storage space (21) are dropped and mixed in the container (100) via an opening and closing hole (22), and if the operating section (30) is moved down under above condition, closing section (35) of opening and closing hole (22) is caught by the removal rack (23), so the opening and closing hole (22) is opened because the closing section (35) of opening and closing hole (22) is tightly fastened on the extension section (34) as shown in the FIG. 10.

The FIG. 11 shows that the extension section (34) of operating section (30) may be assembled in the closing section (35) of opening and closing hole (22) after the closing section (35) of opening and closing hole (22) is assembled in the opening and closing hole (22).

The FIG. 12 shows that the closing section (35) of opening and closing hole (22) may be diversely transformed like the FIG. 11.

Figure 13:
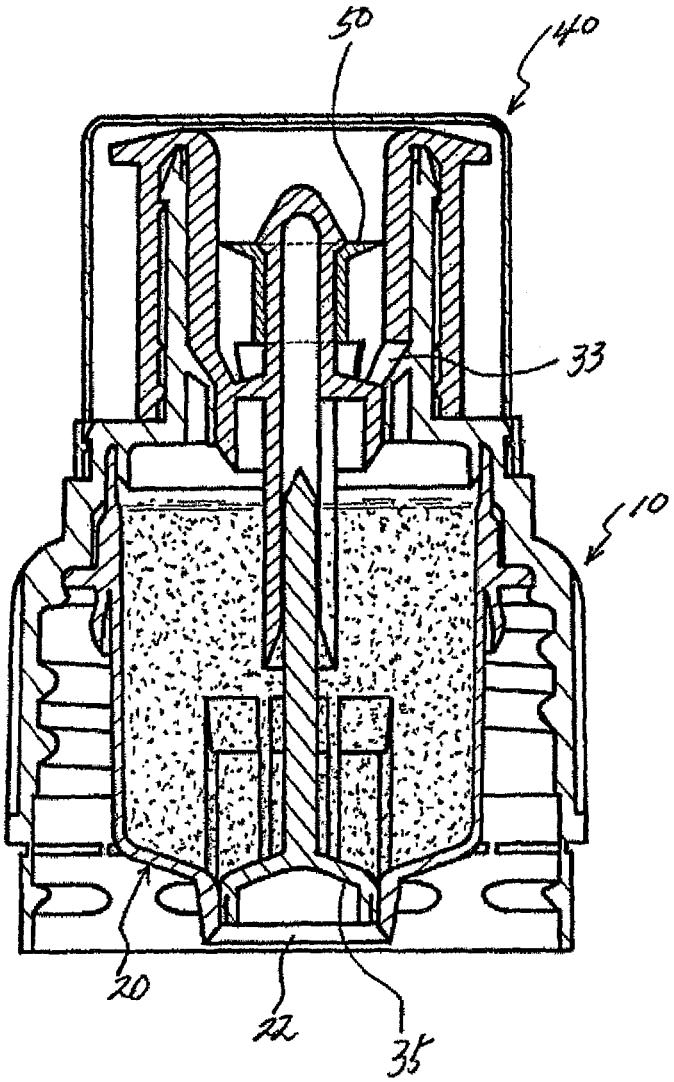
Figure 14:
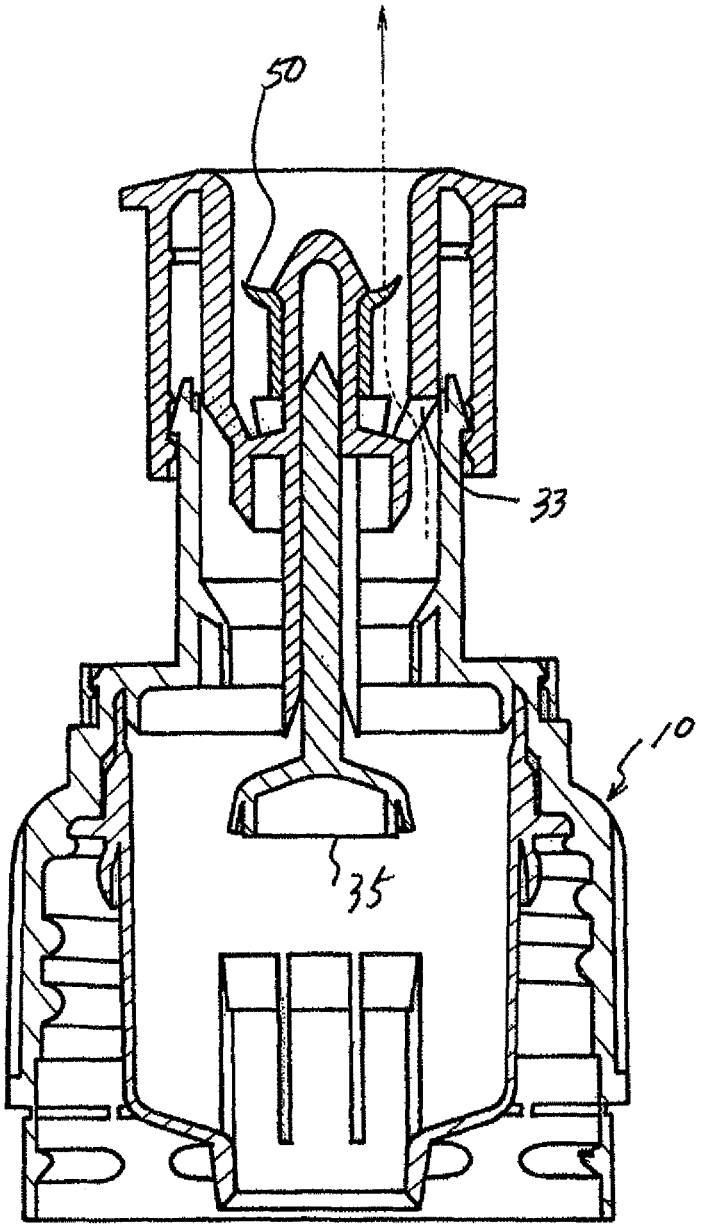

The FIG. 13 shows that the check valve (50) is assembled on the top of vent (33) to prevent the contents from being discharged via a vent (33). The FIG. 14 shows that the check valve (50) is opened by the water pressure of contents to be discharged via a vent (33).

Figure 15:
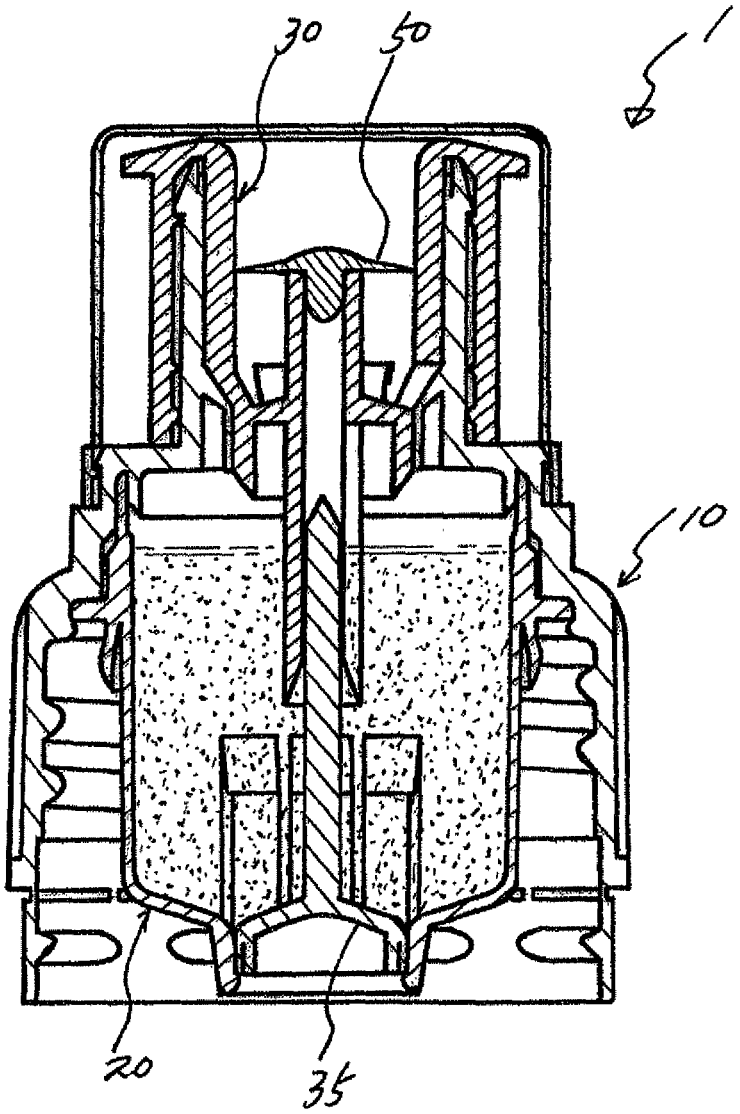

The FIG. 15 shows that the check valve (50) is assembled in the operating section (30) as another operation.

Figure 16:
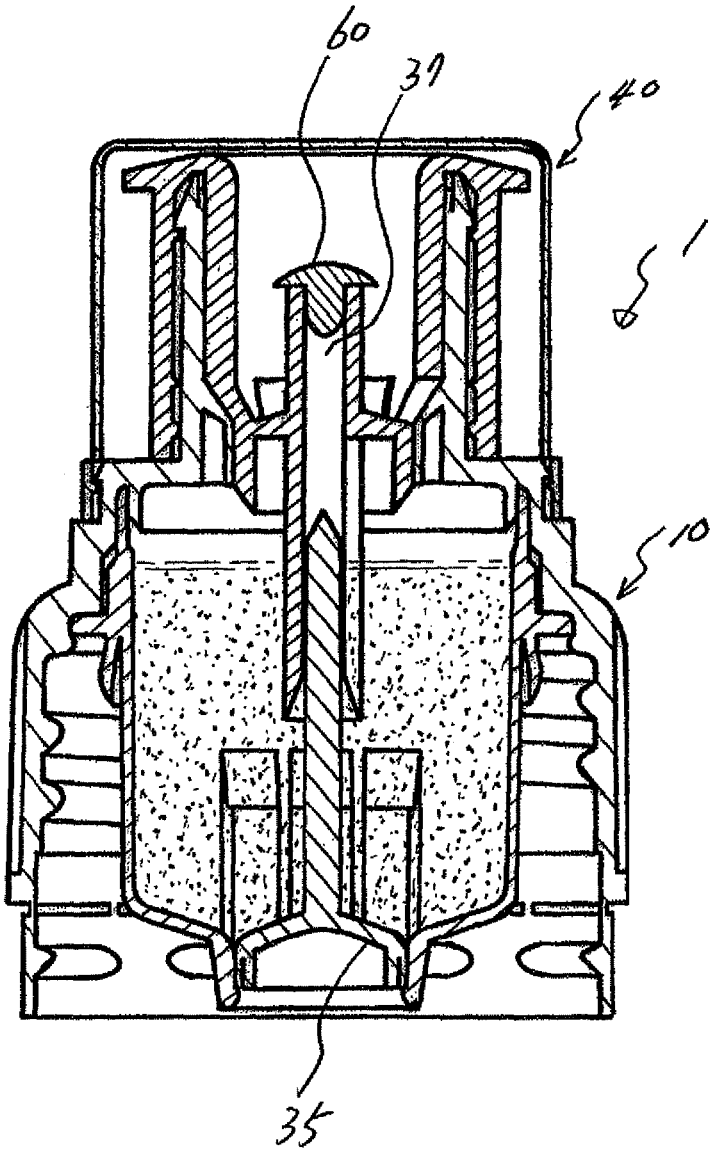

The FIG. 16 shows that the contents may be filled in the storage space (21) via a filling hole (37) mounted on the operating section (30) and above filling hole (37) may be completely sealed by an additional cap (60).

Figure 17:
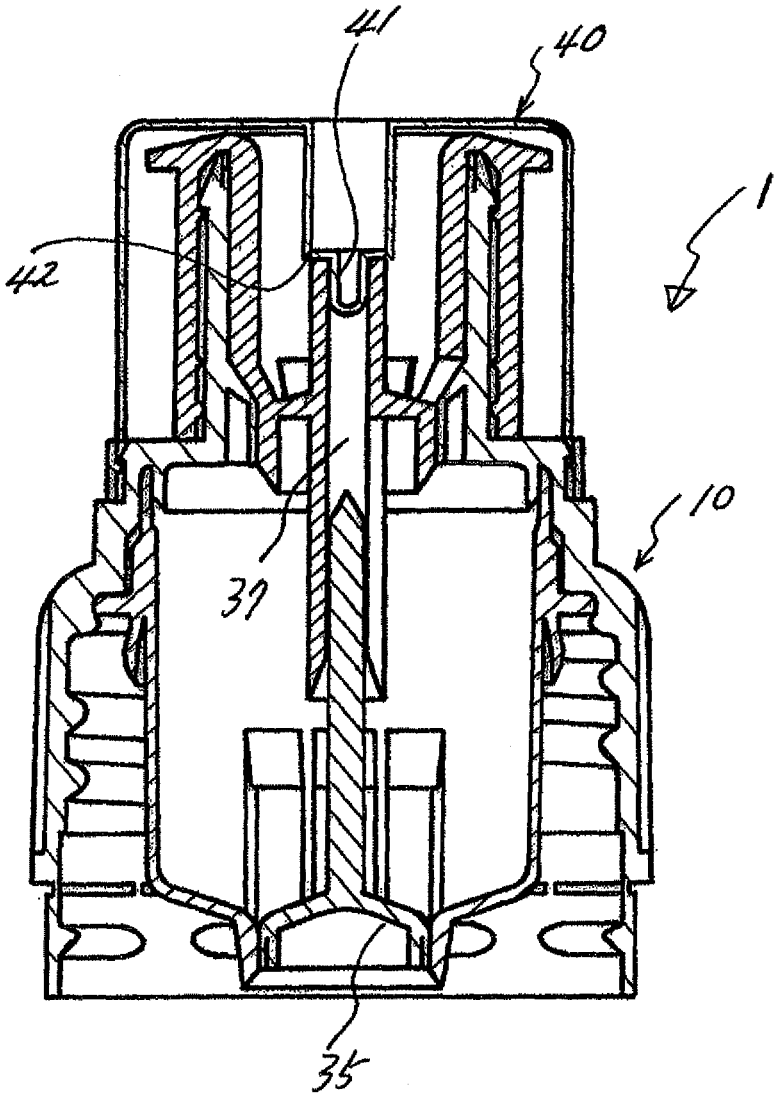

The FIG. 17 shows that the filling hole (37) is completely sealed by the cap (41) mounted on the cover (40) and this cover (40) is opened because the perforated line is damaged when the cover (40) is opened.

The FIGS. 18 thru 20 show another example of transformation. In other words, these figures show that the closing section (35) of opening and closing hole (22) assembled to the extension section (34) stays in the opening and closing hole when the operating section (30) is pulled upward and this closing section (35) closing the opening and closing hole (22) is separated from the opening and closing hole (22) when the operating section (30) moves down and then the contents stored in the storage space (21) are dropped via an opening and closing hole (22) as shown in the FIG. 18.

For this technical format, closing section (35) of opening and closing hole (22) stays when the extension section (34) is pulled upward and moves down accordingly when the extension section (34) moves down by being jammed in the extension section (34).

As shown in the FIG. 21, a vent (33) is made or formed on the top of operating section (30). This vent is closed by the closing section of vent (33) made or formed on the globe (11), and if above operating section (30) moves up, a vent (33) is separated from the closing section of vent (33) and then the contents stored in the storage space (21) are discharged via a vent (33).

The FIG. 22 shows that the closing side (32) of operating section (30) is assembled in the closed side (12) of globe (11) for the airtight.

The FIG. 23 shows that the catching jaw (24) is installed on the bottom jaw of opening and closing hole (22) to prevent the closing section (35) of opening and closing hole (22) assembled in the opening and closing hole (22) from being moved down.

The FIGS. 24 thru 27 show that the opening and closing hole (22) is not closed when the closing section (35) of opening and closing hole (22) moves up and down. The closing section (35) of opening and closing hole (22) is designed to be operated in the extension section (34) for this function.

In detail, some spatial clearance is formed when the closing section (35) of opening and closing hole (22) is assembled in the extension section (34) as shown in the FIG. 24, and if the operating section (30) moves up, closing section (35) of opening and closing hole (22) moves up accordingly as shown in the FIG. 25, and if the operating section (30) moves down under above condition, closing section (35) of opening and closing hole (22) is caught by the removal rack (23), so it does not move down any more as shown in the FIG. 26.

If the operating section (30) moves down any further under above condition, space is getting narrow and then opening and closing hole is not closed because the closing section (35)

of opening and closing hole (22) is jammed in the extension section as shown in the FIG. 26, and if you pull the operating section (30) upward under above condition, closing section (35) of opening and closing hole (22) moves up together with the operating section (30), so the opening and closing hole (22) is widely opened.

The FIGS. 28 thru 32 show that the cap (60) is designed to close the filling hole (37) as shown in the FIG. 28.

The extension section (34) extended downward is positioned based on the filling hole (37) located in the center of operating section (30) as shown in the FIG. 29. However, the flexible closing section (35) of opening and closing hole (22) with movable member is assembled around the opening and closing hole (22) in above extension section.

If you pull the operating section (30) upward under the condition specified in the FIG. 29, closing section (35) of opening and closing hole (22) is separated from the opening and closing hole (22) as shown in the FIG. 30, and if you move down the operating section (30) under above condition, closing section (35) of opening and closing hole (22) is caught by the removal rack, so it is pushed upward in the extension section (34) and opens the opening and closing hole (22).

The FIG. 32 shows that the closing section (35) of opening and closing hole (22) moves up when the operating section (30) is pulled upward under the condition specified in the FIG. 31.

The FIG. 33 shows that the extension section (34) is assembled in the operating section (30).

The FIG. 37 shows that the additionally manufactured extension section (34) is assembled in the closing side (12) of globe (11) located inside the globe (11) as shown in the FIG. 34.

If the operating section (30) with insertion section (38), shown in the FIG. 35, is assembled after the contents are filled via a filling hole (37) under the condition specified in the FIG. 37, insertion section (38) is fixed to the top of extension section (34) as shown in the FIG. 36.

As shown in the FIG. 38, extension section (34) may be assembled after being inserted in the insertion section (38).

The FIG. 39 shows that the closing section (35) of opening and closing hole (22) is assembled in the extension section (34) so that the this section (35) may be operated smoothly and jaw is mounted so that the closing section (35) of opening and closing hole (22) may not be pushed upward and separated from the opening and closing hole (22) when the fine pressure is applied to the container.

The FIG. 40 shows that the closing side (12) of globe (11), where the extension section (34) is assembled, may be diversely transformed.

The FIG. 41 shows that the top of globe (11) is designed to close the vent (33) as an example of transformed vent.

The FIG. 42 shows the components of vent (33) and cap (60). In other words, this figure shows that the contents are filled via a filling hole before the cap (60) is assembled and then cap (60) is closed after the contents are filled for the airtight. Also, this figure shows that vents (33) more than one must be positioned around the cap (60).

The FIGS. 43 and 44 show an example when this invention is transformed.

The FIG. 43 shows that the closing section (35) of opening and closing hole (22) is designed to close the opening and closing hole (22) and enable the pulling projection (39) made or formed on the bottom of closing side (32) of operating section (30) to pull the catching projection (35) when the operating section (30) moves up. Also, this figure shows that the contents stored in the storage space (21) are dropped via an opening and closing hole (22) and closing section (35) of opening and closing hole (22) stays in the interior wall of globe (11) and only the operating section (30) moves down for the mixing process as shown in the FIG. 44.

If the operating section (30) is lifted under the condition specified in above FIG. 44, closing section (35) of opening and closing hole (22) does not move and only the operating section (30) moves up and vent (33) is operated when the closing side (32) of operating section (30) is separated from the closing side (12) of globe (11) and then mixed contents are discharged via a vent (33).

As previously stated, opening and closing hole (22) is opened and contents are dropped and mixed when the operating section (30) is opened after moving up, and the contents do not flow via a vent (33) when the operating section (30) moves down again under this condition.

The FIGS. 43 and 44 show that the technical specification is changed not to allow the closing section (35) of opening and closing hole (22) to move down after moving up.

The FIG. 45 shows other transformations of operating section (30). In other words, this figure shows that the closing side (12) of globe (11) is designed as the wing type for improving the airtight when the operating section (30) is combined to the globe (11). Also, this figure shows that an air inlet (39') is provided in the form of hole or slot to prevent the occurrence of pressure in the storage space (21) by placing the air inlet (39') in the closing section (35) of opening and closing hole (22) when the operating section (30) moves up and down.

The FIG. 46 shows that the jaw or projection is installed so that the closing section (35) of opening and closing hole (22) doesn't flow down under the natural condition after being fixed to the interior wall of globe (11).

The FIG. 47 shows that the elastic hole (350) and closing section (35) of opening and closing hole (22) are not allowed to move down after moving up along the globe (11) to enable the closing section (35) of opening and closing hole (22) to smoothly operate after being combined or connected to the globe (11). In other words, this figure shows that a projection (351) is installed to prevent the elastic hole (350) and closing section (35) of opening and closing hole (22) from moving down after being caught by the catching rack mounted on the interior wall of globe (11).

The FIG. 48 shows that the vent (33) is made on the top of operating section (30) and top of globe 11) plays the role of opening and closing the vent (33).

The FIG. 49 shows that the closing section (35) of opening and closing hole (22) is tightly jammed in the closing slot of opening and closing hole (22) for the airtight purpose.

The FIG. 50 shows that the closing section (35) of opening and closing hole (22) does not move and only the operating section (30) moves down if the closing section (35) of opening and closing hole (22) is opened and operating section (30) is closed when the operating section (30) rotates.

The process showing how the storage (1) consisting of diverse components operates may be construed as a kind of common sense. In other words, how the operating section (30) rotates is a kind of common and anyone who has common knowledge in this field may easily analogize the process, so the diverse transformations are not suggested as an example.

The FIG. 51 shows that the operating section (30) is allowed to rotate within specific level and lift the closing section (35) of opening and closing hole (22).

The operating section (30) moves up and down by the screw thread of globe (11) and separation preventing jaw mounted on the operating section (30) prevents the operating section (30) from being separated from the globe (11).

The FIG. 52 shows another operation of this invention. In other words, this figure shows that the cover (40) designed as the hinge type is connected to the operating section (30) of storage (1) via a connector (43).

The FIG. 53 shows another transformation of cover. This figure shows that the elastic part (44) is installed in the air inlet (45) so that the children's airway may not be clogged even when the children swallow the cover (40).

If the cover (40) is assembled in the operating section (30), air inlet (45) is closed because the top of operating section (30) is influenced by the elastic part (44), and if the cover (40) is opened, elastic part (44) returns to its original position by its restoring force and closes the air inlet (45), so the children's airway is not clogged even when the children swallow the cover (40).

Also, air inlet (45) is closed when the cover (40) is installed in the operating section (30), so it prevents the foreign substance from being stuck to the operating section (30).

INDUSTRIAL APPLICABILITY

This invention is on structure of storage chamber required for effectively mixing the concentrate and water or concentrate and general beverage or granule and water or powder and water. This invention may be used for the diverse purposes to improve the mixing efficiency of different materials such as medical, pharmaceutical, cosmetic and industrial purposes.

The opening and closing hole is not opened and closed again after this hole is opened, so this invention may be effectively applied to the dairy products and powder products to improve the mixing efficiency.

Also, opening and closing hole is not closed once it is opened, so this invention may be safely used for the children's beverage.

The invention claimed is:

1. An apparatus applicable to a container, the apparatus comprising:

a body with a storage space and an operating section mounted around a globe;

the operating section is connected to a closing section designed to close a hole on a bottom of the storage space via an extension section;

the operating section includes a vent designed to discharge contents stored in the container when the operating section moves up; and the closing section opens the hole when the operating section moves up, and when the operating section moves down, the vent is closed while the closing section is not allowed to close the hole.

2. The apparatus of claim 1, includes a boring section used for filling materials in the storage space, wherein after filling the storage space with the materials via the boring section, a closing side of the operating section closes the boring section, so the vent in the operating section is closed from the storage space.

3. The apparatus of claim 2, wherein when the operating section moves up, the closing side of the operating section is separated from a closing side of globe.

4. The apparatus of claim 1, wherein the closing section is designed to be assembled on an extension section.

5. The apparatus of claim 1, including a removal rack mounted in the hole which pushes the closing section upward, so the closing section does not close the hole when the operating section moves up and then down.

6. The apparatus of claim 1, including a removal rack on an interior wall of the hole so that the closing section of the hole does not move down after being caught by the removal rack.

7. The apparatus of claim 1, further comprising a filling section located in a center of the extension section, the filling section closed by a cap.

8. The apparatus of claim 1, wherein the closing section is assembled around a bottom of the extension section in the form of a ring, which opens the hole by moving up when the operating section moves up and which does not close the hole when the operating section moves down because the ring is caught by a removal rack.

9. The apparatus of claim 8, wherein the closing section is made of flexible resin.

10. The apparatus of claim 1, including a pulling projection of the operating section is caught by a catching projection, whereby the closing section moves up when the operating section moves up.

11. The apparatus of claim 1, wherein the closing section coheres to an interior wall of the globe, whereby the closing section does not close the hole when the operating section moves up and down.

12. The apparatus of claim 1, including a jaw on an interior wall of the hole so that the closing section of the hole does not move down after being fixed to the jaw.

13. The apparatus of claim 1, including an elastic ring in the closing section whereby the closing section may be smoothly operated.

14. The apparatus of claim 1, including a resistance projection in the closing section whereby the closing section does not move down after moving up.

15. The apparatus of claim 1, including a hinge type cover mounted on the operating section.

16. The apparatus of claim 1, including an air inlet in a protecting cover mounted on the operating section whereby an airway of a human body may not be clogged.

* * * * *